US009175549B2

(12) United States Patent
Paturu

(10) Patent No.: US 9,175,549 B2
(45) Date of Patent: Nov. 3, 2015

(54) EMERGENCY SALVAGE OF A CRUMBLED OCEANIC OIL WELL

(76) Inventor: Sumathi Paturu, Birmingham, AL (US)

( * ) Notice: Subject to any disclaimer, the term of this patent is extended or adjusted under 35 U.S.C. 154(b) by 818 days.

(21) Appl. No.: 13/134,370

(22) Filed: Jun. 6, 2011

(65) Prior Publication Data

US 2012/0305260 A1 Dec. 6, 2012

(51) Int. Cl.

| | |
|---|---|
| ***E21B 43/01*** | (2006.01) |
| ***E21B 33/06*** | (2006.01) |
| ***E21B 33/12*** | (2006.01) |
| ***E21B 33/127*** | (2006.01) |

(52) U.S. Cl.

CPC ..... *E21B 43/0122* (2013.01); *E21B 33/06* (2013.01); *E21B 33/12* (2013.01); *E21B 33/127* (2013.01); *E21B 33/1208* (2013.01)

(58) Field of Classification Search

CPC ..... E21B 43/0122
USPC ..... 166/352, 363, 364, 79.1; 405/60, 224.2
See application file for complete search history.

(56) References Cited

U.S. PATENT DOCUMENTS

| | | | | |
|---|---|---|---|---|
| 3,548,605 | A * | 12/1970 | Armistead et al. | 405/60 |
| 3,664,136 | A * | 5/1972 | Laval et al. | 405/60 |
| 4,323,118 | A * | 4/1982 | Bergmann | 166/96.1 |
| 8,016,030 | B1 * | 9/2011 | Prado Garcia | 166/75.13 |
| 8,186,443 | B2 * | 5/2012 | Wolinsky | 166/364 |
| 8,196,665 | B2 * | 6/2012 | Wolinsky | 166/356 |
| 8,322,437 | B2 * | 12/2012 | Brey | 166/363 |
| 8,434,558 | B2 * | 5/2013 | Swanson et al. | 166/368 |
| 8,522,881 | B2 * | 9/2013 | Worrall et al. | 166/344 |
| 2011/0274493 | A1 * | 11/2011 | Cutts | 405/60 |
| 2011/0299930 | A1 * | 12/2011 | Messina | 405/60 |
| 2012/0055573 | A1 * | 3/2012 | Adams | 138/89 |
| 2012/0247784 | A1 * | 10/2012 | Lacy | 166/363 |

* cited by examiner

*Primary Examiner* — Matthew Buck

(57) ABSTRACT

Catastrophic events involving oceanic petroleum oil-wells are threats to ventures in this intriguing avenue. The instant inventions of exemplary models working in synchrony are directed to emergency responsive, reparative, and preventive measures to weather through the adversities of such deep sea explorations, thereby restoring/preserving the functioning of the well structure, involving—

Figure 1A:
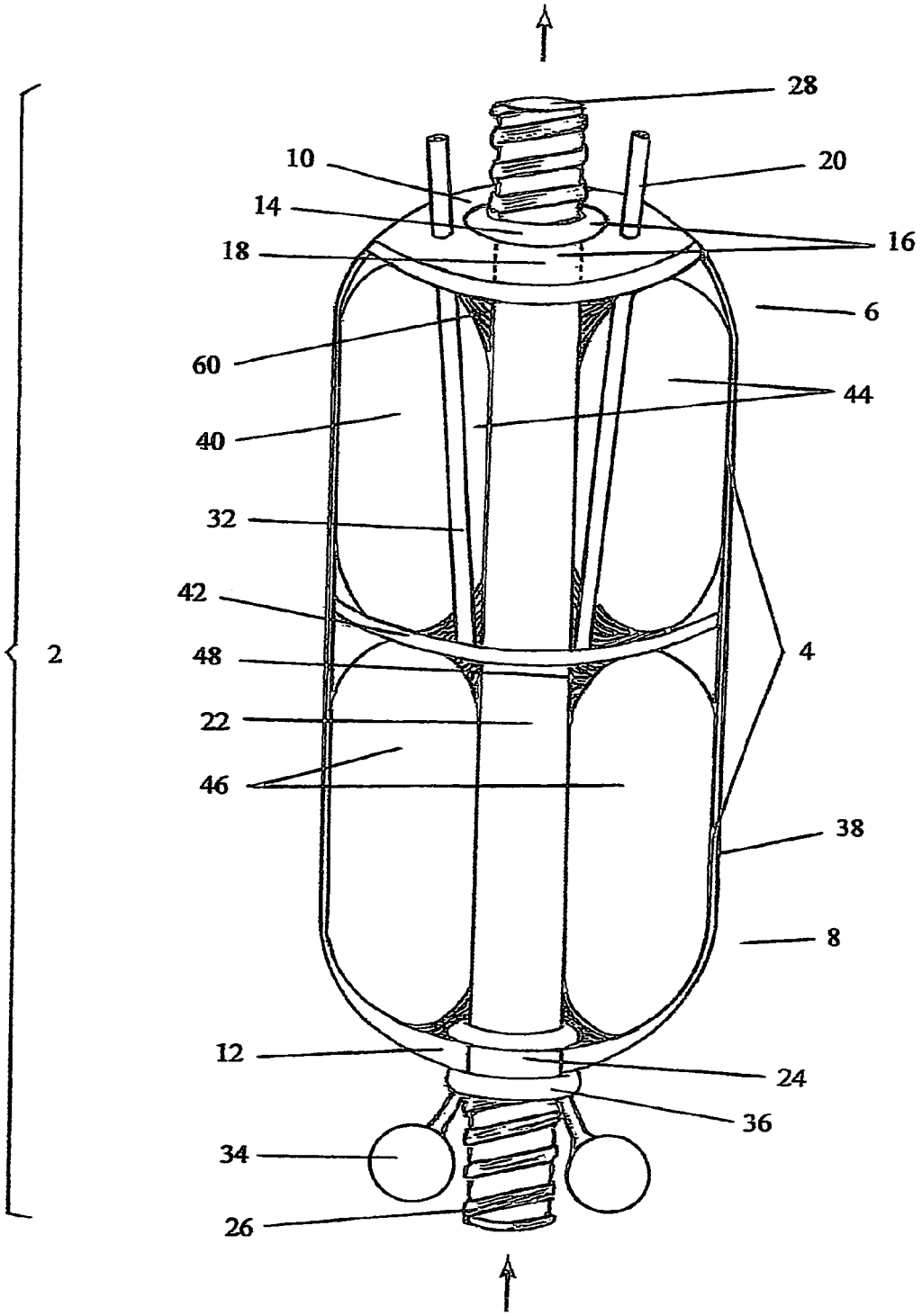

(a) An incomplete oil-well with disrupted 'production casing', it's dimensions sealed by an 'Emergency Pneumatic Sealing Ensemble', further incorporating an oil-outlet, (b) A completed oil-well with fractured 'production tubing', it's dimensions sealed by a pneumatic 'Emergency Plugging Oil-Conduit', (c) Reparative measures of cement structuring an 'Emergency Isolation platform' incorporating functional well-head structures, (d) Methods of designing a 'Detachable Island-Rig' on permanent base, (e) A simple yet eminently functional model of 'Oil-Gas Separator', structured on the ocean grounds about the well, designed to separate gas from semisolid crude, so preventing entrainment of inflammable gases.

8 Claims, 10 Drawing Sheets

EMERGENCY SALVAGE OF A CRUMBLED OCEANIC OIL WELL

BACKGROUND INFORMATION

The embodiment of invention is directed to plurality of mechanical devices and their utility methods for the emergency salvage of a blown out oceanic petroleum oil well, incorporating means of not only sealing oil leak from the well bore in an effective and immediate manner, but also resorting to emergency reparative processes at the distorted well head and beyond, that an optimal structural and functional state of the well is restored, stopping the 'vicious cycle' of mere leak from the disrupted well turning to a spewing geyser into the ocean.

There are innumerable petroleum oil wells bored into the oceanic floor by highly evolved modem technological devices to tap the petroleum (gas/crude oil) reservoirs. Many oil wells are clustered in the Gulf of Mexico, Arabian sea and such oceanic grounds, often of significant distance from the coast line, such wells bored into the ocean floor as deep as a mile from the surface waters, to find their way into the underground oil containments spread many miles in area. Oil is collected from the wells into surface tanks in moderate containers, or into receptacles as large as ships.

The boreholes or shafts laboriously made into the oceanic floor to tap the geological oil reservoirs are modem wonder which improved in technology over decades. The drilling of boreholes that form the tunnels of the wells in the ocean ground are accomplished by innumerable varieties of 'Drilling Rigs', a drilling rig being defined as—'an unit of equipment built to penetrate the superficial and the deeper aspects of the earth's crust'. The rigs can be built as small and portable to be moved by a single person, or they can be enormous in size and complexity of functioning so as to house equipment used to: drill oil wells; sample mineral deposits that can impede functional units; identify geological reservoirs; install underground utilities. Large units (rigs) generally configured as more permanent land or marine based structures in remote locations are also facilitated with living quarters for laboring crews involved in well construction, at times hundreds in number.

Hydraulic rotatory drilling originally devised by Anthony Francis Lucas, is utilized in oil well drilling. All bore wells employ inner 'casing annulus' during construction of the bore tunnel of the well leading to the underground reservoir. The casing annulus is a hollow sheath which protects the hole against collapsing during drilling, and is made up of metal (steel) or PVC (polyvinyl chloride).

The bore well has a nested configuration, that is, it narrows down as it courses down into the deeper layers of the earth's crust, and hence the deeper metal/PVC annuli of casings are built to be progressively smaller. The standard casings are usually 40 feet (13 meters) in average length, and available in 14 casing diameter sizes, spanning 7-30 inches in outer diameter.

The drilling and production of oil and gas from the earth's mantle in the ocean floor is shrouded with risk and great hazard to the natural environment that includes both the marine life forms and the terrestrial ecosystem adjacent. The many hazards, to list a few, include ignition of the entrained highly inflammable gases like Methane causing dangerous fires, and the risk of oil spewing and polluting the sea water. Such two man-made calamities at the same time can be uncontrollable with available resources, and utterly devastating to the healthy existence of the earth's planetary life forms. For these reasons, error-proof safety systems in under water bore well digging, and highly trained personnel are required by law in all countries engaged in significant oil production. Despite such stringent laws, system failures and catastrophic results did occur historically (and still occurring), though derived remedial measures through each 'adverse-event experience' uniquely different from the other in some form or other, are still nascent and less than perfect.

Recent event in the gulf shores of Mexico involving BP oil company's oil well (Deep Water Horizon) under construction, wherein the ignition of the entrained Methane gas and it's fire that continued unstopped for 36 hours, resulted in collapse of the surface structure of the oil well with an ever increasing gusher from the source. Several different attempts from BP oil company's technical team to contain the spewing geyser from finding it's way into the body of water, and into the gulf shores had failed, mostly due to the inherently limited robotic attempts involved in a moderately deep aquatic habitat.

In the prevailing oceanic climate of the oil wells, after a bore well structure is disrupted, the sea water continuously gets into the oil well, whereas the oil rises to the surface, because of the relative densities of each, that could be contributing to the spewing of oil gush at a later time, while it would be only a spill to start with. There would be churning forces set forth at the land mark area of the disrupted bore well surface, the sea water trying to get in, while the lighter petroleum/crude oil is trying to get out. As the ocean water forcefully fills the underground oil containment space (the hydrostatic pressure at any point in the ocean being proportional to the true vertical depth), the pressure will rise more and more in a very short time, forcing the lesser dense oil to progressively rise into the ocean like an eruption.

Accordingly, it is imperative that immediate action be taken to contain the leak, and stop the sea water pouring into the containment of underground reservoir that will effectively dampen the rising pressure within it's confined space, further reducing the spewing force of the oil gusher—thus breaking the vicious cycle. The calamity in gulf shores happened before the 'Production Tubing' and the 'Production Packer' were installed, and the wide 'A' annular space acted as the tunnel for the oil gusher. As a result the sea water very quickly found it's way through the expansive oil well bore, and the oil in turn rose to the surface with a greater force. It was worse due to the absence of down hole safety valve (DHSV) which is usually placed in the 'Production Tubing' (the valve being the last resort to contain the leak from the disrupted well) as far below the surface as deemed safe, to be unaffected by any events leading to wipe out of the surface well head platform.

As any unforeseen adversity can happen at any time before the completion of the well to it's last functional detail, safety measures to weather off such events at any step of the construction have to be in place, before beginning to undertake such operation.

The following embodiments are primarily structured to counteract the events when a 'fire-blow out' of the well head platform destroys any of the security devices before the well completion, wherein the timing of the adverse events to be countervailed are similar to that of the BP's Deep Water Horizon Oil Well blow-out i.e. before the production tubing and the production packer' are installed, OR in high production wells not destined to incorporate a production tubing and production packer when the whole annulus space (the 'A' annulus) is used as the oil production conduit. Other devices and methods are also included to counter adverse events in other contexts, and additionally, to prevent and alleviate the problems inherent to the prevailing oil production endeavors of the industry either or not so far recognized, nonetheless not so far addressed. The dictum 'prevention is better than cure' prevails more than any under any circumstance, especially when such endeavors are impressively simple, and impressively effective.

The inventions herein disclosed are directed to prevent and alleviate many of the problems discussed above though it is neither intended nor implied that the originally planned well structure is restored, but a functional order is definitely emphasized and resulted, however, as stated, manifestly different from the established norm. Such differences are being practiced on a regular basis even in the oil industry (example—some high production wells are structured to operate without any 'Conduction Tubing' and 'Conduction Packer' usually incorporated within the casing 'A' annulus). But the undeniable incentive to accommodate some difference(s) from the practicing standards in an industry where such standards are justifiably warranted is: it's/their ability to weather through a calamity with catastrophic consequences even in situations where norms and standards were followed throughout the well construction, and later during it's maintenance—a classic example that the 'forces of nature' are not always necessarily contained by practicing rigorous standards, and what seems like a 'difference' may indeed work to contain what proved to be an uncontainable calamity.

Every effort was made to devise and describe the following invention with the best rationale, and with the available information at the time of this writing. However, the Author Inventor is neither legally liable nor personally responsible for any inadvertent errors or omissions, or for any 'adverse events' difficult to differentiate either as a mere association or as a consequence of application of the structural and procedural information enumerated. Additionally, many inadvertent and unforeseen consequences were/are inherent to such ventures as the deep sea explorations and the like, shrouded in dangers and never ceasing mystery, and counting always on the tides of nature yet to be conquered by technological sophistication. Accordingly, application of this disclosure in different situations, innumerable and unique, is a personal choice. Furthermore, understanding, analyzing, and adapting swiftly as needed, to diverse situations, still remain as the professional discretion, expertise, and the deemed responsibility of the involved company and it's associates participating in the day to day practice in the implementation of this invention, in part or as a whole.

BRIEF DESCRIPTION OF THE INVENTION

The embodiments of invention herein disclosed are directed to the emergency devices and their functions, to not only effectively seal the oil gusher from a blown out oceanic petroleum oil well, but also to establish an immediate and effective oil out-let system, set forth to optimize the mounting pressure within the bore well and it's source of oil containment (the bore well being complete or yet to be complete in it's structural mandates), such an ordinate function effectuated by devices working in synchrony to achieve ultimate results deemed optimal and lasting. The disclosure is inclusive also of reparative devices and their methods at the well head and it's vicinity, when such structures are disrupted. The disclosure further enumerates structural measures following a catastrophic event, to effectuate an emergency rig-salvage that envisions an emergency 'Detachable Island Rig' and also methods for preventing a giant gas bubble formation at the source so as to keep the rig from being a venue of danger, difficult to contain.

The following are the embodiments of the invention—

The Emergency Sealing and Stabilizing Devices of a Disrupted Oceanic Oil Well:

(1) (a) 'Emergency Pneumatic Sealing Ensemble' unit (EPSEU): it is devised both as a 'more evolved design', the Emergency 'Evolved Pneumatic Sealing Ensemble' (the EPSE), and a simple design, as in an Emergency 'Simple Sealing Ensemble' (the SSE);

(b) 'Emergency Oil Connecting and Stabilizing Unit' (EOCS unit)—it connects the EPSE/SSE device and the 'Emergency Stabilizing Unit Incorporating a Well Head-like Device' (ESUWH) at the well head.

(2) 'Emergency Stabilizing Unit with a Well Head-like Device' (ESUWH)—it is effectuated on the well surface, and is made of heavy weight metal (steel), to stabilize the buoyant effects of any sealing device.

(3) 'Emergency Plugging Oil Conduit' (EPOC).

The Emergency 'Preventive and Reparative' Devices and their Methods—at the Well Head and Beyond:

(4) 'Emergency Isolation Platform' (EIP) of the well surface, with devices to be incorporating the well head structures.

(5) Emergency 'Detachable Island Rig' (DIR).

(6) A model of 'Oil Gas Separator' (OGS) near the well head—the unit is structured on the sea floor, particularly designed to separate the gas from the liquid and semisolid crude of petroleum oil to mitigate Blow Out Preventer (BOP) failure due to entrainment of inflammable gases under high pressure.

(7) Threaded instant joint structures and caps—to instantly connect or close tubular systems.

The Emergency Sealing Devices of a Disrupted Oceanic Oil Well:

(1) The Emergency Pneumatic Sealing Ensemble Unit (EPSEU)—

The prototype embodiment for an emergency sealing of a disrupted oceanic petroleum oil well is an Emergency Pneumatic Sealing Ensemble Unit (EPSEU) functioning as an emergency seal in the well bore of the leaking oil well, deployed within hours with no wait time, along with incorporated oil conduit and buoyancy stabilizing components. It is the most important and cost effective device, as an immediate measure. The sealing ensemble is structured in two designs—(1) an Emergency 'Evolved Pneumatic Sealing Ensemble' (the EPSE), and (2) an Emergency Pneumatic 'Simple Sealing Ensemble' (the SSE)—to be used in the settings of either a disrupted or a non-disrupted innermost casing of the bore well respectively, as identified by the video and sonar devices. The EOCS unit that traverses the bore well connects the EPSE/SSE device with the ESUWH at the well surface.

The foregoing are preferable devices for a well under construction, that is, when the casing is completed, but the 'production tubing' and the 'production packer' are not yet installed, wherein it's innermost casing (the 'A' annulus) is the annulus of concern aimed for an effective sealing (example—the BP's Deep Water Horizon Oil Well blow out).

(2) The 'Emergency Stabilizing Unit with a Well Head-Like Device' (ESUWH)—

An additional embodiment, the 'Emergency Stabilizing Unit with a Well Head like Device' (ESUWH), an invariable accessory to the foregoing device (the EPSE/SSE), is a heavy weight table-like metal (steel) structure having outwardly spanning legs with gradually widening bottoms, to be drilled into the sea bed, and cemented. Being a simple structure, it can be drilled swiftly into the sea floor, even by robotic instruments. The thickened and elaborated center of the circular table top accommodates well head-like structures with an oil conduit that is connected to the EPSE/SSE stationed in the well bore. By it's sheer weight and cementing to the sea floor, it overcomes the buoyancy effects of the EPSE/SSE device. When the 'EMERGENCY ISOLATION PLATFORM' (EIP) at the well surface, described in the subsequent section (4) below, is constructed, the well head-like structures of the ESUWH are incorporated into the platform.

(3) the Emergency Plugging Oil Conduit (EPOC)—

The 'Emergency Plugging Oil Conduit' (EPOC) is yet another embodiment that effectively plugs the 'production tubing' of a fully constructed oceanic oil well, if the production tubing is fractured (with linear or circular cracking), or partially or completely severed by surface blow out of the well. Such damage to the production tubing is usually located near and adjacent to the well surface.

The Emergency Preventive and Reparative Devices and their Methods at the Well Head and Beyond:

These reparative and preventive devices are captioned as emergent because they are either reparative/responsive subsequent to a catastrophic situation, or preventive of consequences in a calamity that could otherwise culminate in a total devastation, that is, these preventive measures are in place to be actuated as countervailing emergency responses.

(4) 'Emergency Isolation Platform' (EIP) of the Well Surface with Devices to be Incorporating the Well Read Structures—

Emergency Isolation Platform (EIP) is a model design for incorporating the well-head like device (ESUWH), and is a permanent reparative/restoration structure at the well surface surpassing the maximum Diameter Of Disruption (DOD), to be built on a footage of reliable ocean grounds.

(5) The Detachable Island Rig (DIR)—

A Detachable Island Rig (DIR) can be planned to be incorporated even in permanently stationed off shore rigs, the latter favored by oil companies due to stable working platform of the rig. For the involved complexity, the cost of equipment, and the life/morale of the personnel involved, even a major part of a permanently based off shore rig should be an urgently detachable island from the 'conduction platform', the possible site of the initial and ongoing fire or explosion.

(6) A Model Oil Gas Separator (OGS) Near the Well Head—

A model of 'Oil Gas Separator' (OGS) is devised to be structured on the sea floor, particularly designed to separate the components of gas from the liquid and semisolid crude of petroleum oil, so that highly inflammable gases never find their way into the rig, a venue of danger. The OGS model incorporated into the oil collection system about the well head will further mitigate the failure of the measured operations of the Blow Out Preventer (BOP) due to entrained gas under immeasurable pressure.

(7) The Threaded Instant Joint Structures—

The invention further provides novel model of tubing directed to all tubular systems, said tubing structured to be having a threaded configuration on the inside or the outside, traversing the whole length, facilitating instant joining or closing of a broken or intact system, aided by means of 'instant joint structures' shaped as I, T, J, L, C, U etc. having straight or nested configuration, or closing caps with complimentary threading.

The Terminology Emphasized

The device and the description when denote the terms 'upward', 'up', 'rear', and 'above'—they refer to the opening side of the bore well to the ocean side, whereas the terms 'lower', 'low' and 'below' refer to the oil containment side underneath the ocean floor. Furthermore, the leading/diving end or the head end of any instrument or device is the lower end of that device or instrument in the bore well, both terms being referred in upright position.

Figure 1B:
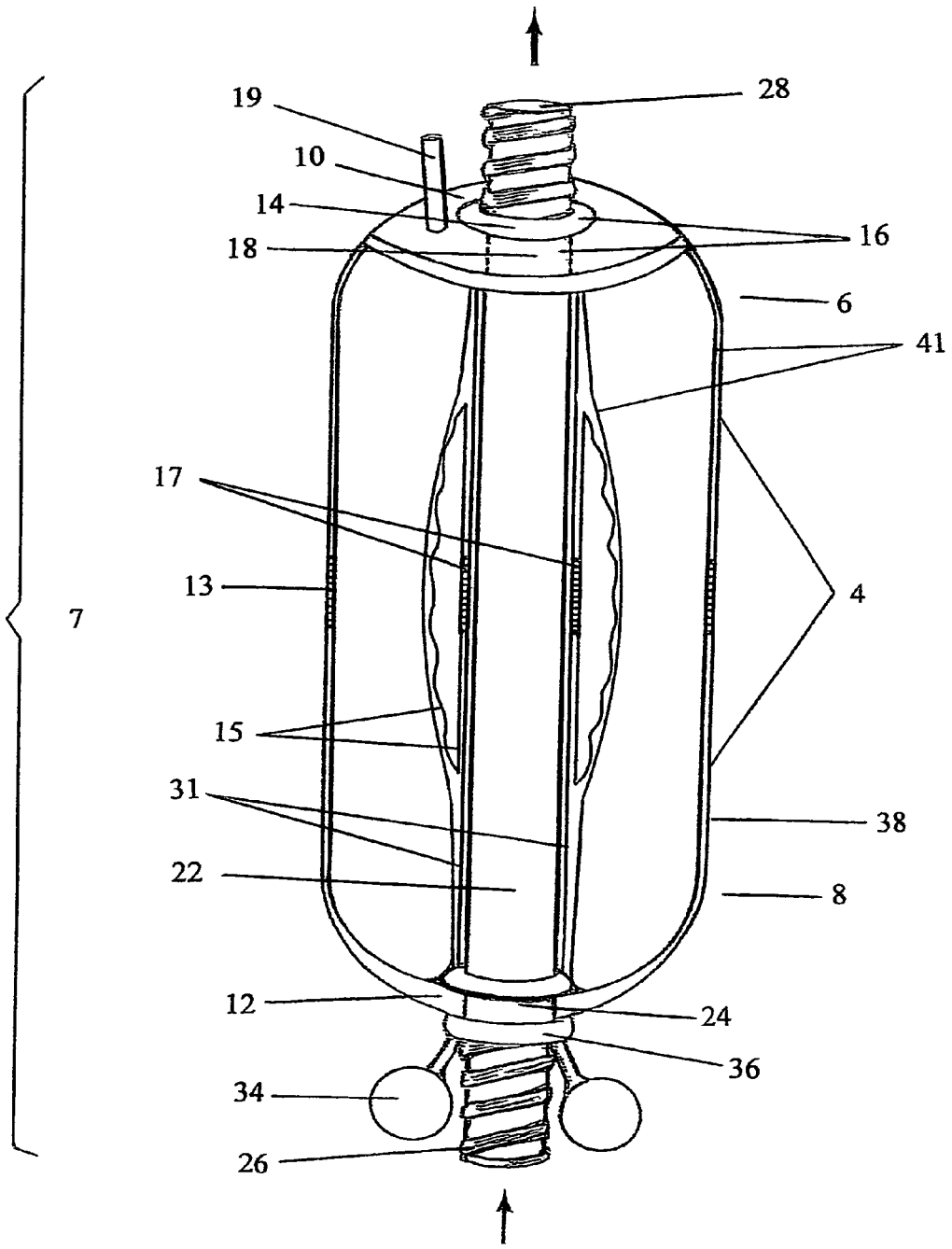

DRAWINGS (1) FIG. 1 A: A schematic cut section-in-part of an Emergency 'Evolved Pneumatic Sealing Ensemble' (the EPSE), in it's vertical disposition, showing a more involved/evolved design of the EPSE, FIG. 1B: A schematic cut section-in-part of an Emergency Pneumatic 'Simple Sealing Ensemble' (the SSE), in it's vertical disposition, showing a simpler design of the SSE, (2) FIG. 2 A: A schematic diagram of a horizontal cross-section of an Emergency 'Evolved Pneumatic Sealing Ensemble' (the EPSE), showing structures at all strategic levels, FIG. 2 B: A schematic diagram of a horizontal cross-section of an Emergency Pneumatic 'Simple Sealing Ensemble' (the SSE), (3) FIG. 3: A perspective view of a joint articulation of air tube connections with a sliding screw arrangement, (4) FIG. 4: A schematic diagram of an 'Emergency Plugging Oil Conduit' (EPOC), (5) FIG. 5: A schematic diagram of the plan of an 'Emergency Isolation Platform' (EIP) of the well surface, with devices to be also incorporating the well head, (6) FIG. 6: A schematic diagram of a model design and plan of an 'Emergency Detachable Island Rig' (DIR), (7) FIG. 7: A schematic diagram of an anchoring model of a 'Detachable Island Rig' (DIR) onto a permanent base structure, (8) FIG. 8: A schematic diagram of a model of 'Oil Gas Separator' (OGS) near the well head, designed to separate the components of gas from the liquid and semisolid crude of petroleum oil.

DETAILED DESCRIPTION OF THE INVENTION

The embodiments of invention herein disclosed are directed to the emergency devices and their functions, to not only effectively seal the oil gusher from a blown out oceanic petroleum oil well, but also to establish an immediate and effective oil out-let system, set forth to optimize the mounting pressure within the bore well and it's source of oil containment (the bore well being complete or yet to be complete in it's structural mandates), such an ordinate function effectuated by devices working in synchrony to achieve ultimate results deemed optimal and lasting. The disclosure is inclusive of reparative devices and their methods at the well head and it's vicinity, when such structures are disrupted. The disclosure further enumerates structural measures with means plus functions, following a catastrophic event, to effectuate an emergency rig-salvage that envisions an emergency detachable island rig. Furthermore, there are devices and their methods to preventing a giant gas bubble formation in the oil-collection system, by diverting the inflammable gases from the petroleum/crude oil at the source, at the earliest, thereby mitigating the failure of the measured operations of the Blow Out Preventer (BOP) due to entrained gas under immeasurable pressure, so as to keep the rig from being a venue of danger from an ignition fire, proved difficult to contain.

The devises listed and their functions briefly outlined in the foregoing section are herein further detailed in sections 1-7.

(1) The Emergency 'Evolved Pneumatic Sealing Ensemble' (The EPSE) with an Involved/Evolved Design—

It is an embodiment of an exemplary design to be used with no wait time and within minutes of a catastrophic event, resulting in disruption/collapse of an oceanic oil well head, and it's vicinity. The disclosure contemplates a prototype model of a strong inflatable vulcanized rubber device resistant to solvents of concern, like petroleum analogs/sea water. It is inflated to desired size and seal the whole circumference at a suitable site within the leaking bore well, to fully or partially stop the flow of the oil gusher resulting from a damage to the original bore well structure by whatever means, but mostly due to highly inflammable gas-fire destruction/explosion.

Through an oil conduit within it, the EPSE device is connected to the 'EMERGENCY OIL CONNECTING AND STABILIZING' unit (EOCS unit) that not only counteracts the buoyant effects of the EPSE device at it's stationed position in the bore well, but also serves as an oil conduit by it's ultimate connection to the cemented heavy weight ESUWH device encompassing oil-outlet tubing, at the well surface.

It is also implied that soon after the catastrophic event, a submarine robotic unit is stationed at the well head that controls and monitors the functional and safety devices, such unit further improvised with air chambers to supply air to the EPSE unit. The EPSE unit is devised for situations when a blow-out happens while the construction is about to complete, as it occurred in BP's Deep Water Horizon Oil Well, in which the 'production tubing' and the 'production packer' were not yet installed, after the well casing was completed. Accordingly, the diameter of the leaking annulus or the 'A' annulus (with the innermost casing forming it's outer boundary), usually encountered in a diameter of 9 and $5/8^{th}$ inches—is the diameter of concern, that needs to be effectually sealed. The corresponding EPSE unit built with an average diameter of 8" for effective passage, at times can be diagonally compressed to maneuver through projecting obstacles if any, until it reaches the destined area of totally preserved casement interior of the oil well, to be inflated for it's wedging. The device is also available in higher/lower diameters to be used in bore wells with higher/lower diameter 'A' annulus, when higher/lower standard sizes are used as the inner most casing.

The EPSE device is made of vulcanized rubber (a polysulfide elastomer). Vulcanization gives rubber unique physical, dynamic, and chemical properties. The main polymers subjected to vulcanization are polyisoprene (the natural rubber), and styrene-butadiene rubber (SBR). During vulcanization some C—H bonds of the rubber are replaced by chains of sulfur atoms. It gives properties of better heat resistance, flexibility without cracking, elasticity, and expandability like a car tire. Vulcanized rubber is also abrasion resistant. Vulcanized rubber is insoluble in petroleum, and is used to make gasoline hoses routinely used in gas stations. Ordinary rubber is also very hard to be dissolved in any solvent/medium. Naphtha, a petroleum distillate is the only petroleum substance that can dissolve rubber when rubber is fragmented into small pieces and immersed in the solvent. The crude oil contains 15-30% naphtha by weight, and generally contains lower than that amount when it is admixed with sea water in a destroyed bore well. It needs to be noted that all the bolt joints and assembly washers of rubber for all the devices and structures herein described, shall also use vulcanized rubber to specifically resist the degrading attack of petroleum analogs, the solvents of concern in this setting.

The depth where the EPSE device has to be stationed is variable depending on the severity of destruction. Prior estimates by video and sonic devices are necessary to map the general configuration of the well structure for a substantial distance in it's depth, to mark out the level from where the cross sectional integrity of the well bore deeper is still preserved all through, in it's entire circumference. It is the ideal level to station the pneumatic sealer ensemble. Because of the inherent adaptability of the pneumatic device, a substantially complete and tight seal is expected, especially with the involved height of the device. It has to be further noted that any irregularities/breaches in the circumferential counter of the bore well above it's stationed position will not generally impede the function of the devised assembly as an effective gas/liquid sealer, thereby ultimately preventing the leak at the well head.

The Emergency Pneumatic Sealing Ensemble (EPSE) is built with the projected total diameter of the inflated pneumatic sealer to far exceed the bore well diameter it is stationed at, for tight and secure wedging, but the pressure needed for such wedging is calculated to be below the 'burst pressure' with sufficient safety margin. It is possible to be still functional when it is less than maximally inflated, but it is not possible to wedge even at maximal inflation if it is of the same diameter or of lesser diameter than that of the well bore. In other words, it is workable erring in over sizing (yet in a size that would not impede it's passage) instead of under sizing. If there are significant metal projections in the entry area, the device can be made leaner with strong compressive rubber bands that can be cut immediately after the obstacle is passed, as doing this nearer to the surface is better.

FIG. 1 A shows a schematic cut-in-part sectional diagram of the EPSE device in it's vertical disposition. FIG. 2 A further depicts a horizontal cross sectional view of the EPSE device showing it's important structures at all strategic levels. Both views are described simultaneously for better understanding of the structure as a whole, and the corresponding functions to relate with the structures are also simultaneously described.

FIG. 1 A depicts EPSE device 2 having a generally cylindrical body 4 except for a spindling upper (or rear) end 6, and a spindling lower (leading) end 8 that are dome shaped in their upper and lower surfaces. The upper Dome (UD) 10 and the lower Dome (LD) 12 are comprised of structures heavily reinforced in their thickness for a natural thrust needed during the navigation of the EPSE device in the well bore. FIG. 1 A depicts the upper dome 10 showing the exterior face of a flange 14 of a metal (preferably steel) spool 16, with the central hollow 18 of the spool 16 traversing the center of the whole thickness of the dome 10.

Both FIG. 1 A and FIG. 2 A show the central structure of the EPSE device 2 that houses a wide bore steel tube 22 that functions as the EPSE body oil conduit (of 5-10 cm diameter, similar to the diameter of the standard 'production tubing'). The oil conduit tube 22 is connected to the hollowed structure 18 of the spool 16 of the dome 10 above, and the hollowed spool structure 24 of dome 12 below, thereby forming a continuous tube which functions as the petroleum oil conduit of the EPSE device that is also continued as lower oil inlet tube 26 below the LD 12, and as the oil outlet tube 28 above the UD 10. The oil outlet tube 28 has exterior threading that compliments the threading of the 'Oil Connecting and Stabilizing Unit' (EOCS) that is to be attached in segments to the EPSE ensemble during it's progressive descent and measured navigation into the bore well.

Both the metal spools housed in the domes 10 and 12 have plurality of joint bolts that pass through the whole thickness of the domes, and secured to the exterior and the interior flanges by metal screws in corresponding locations. Such arrangement reinforces the metal and rubber joint (i.e. the spool and the dome joint) apart from the conventional joining by rubber glue, contact cement etc. Obviously, the domes 10 and 12, and the corresponding upper and lower ends of the EPSE ensemble are lesser in their diameters compared to the rest of the body 4 of the device, as it is intended that the leading end maneuvers through the well bore by the thrust imparted by it's thickness coupled with the spindled fore structure.

The additional structures of the lower dome 12 are pendulum-like structures 34, 3-4 in number, that are attached in equidistance to the perimeter of the exterior flange 36 of the dome 12. The heavy metal pendulum-like structures 34 add to some of the required weight needed for the thrust to navigate the device initially in the bore well, and further, to counteract the buoyant effect of the EPSE device 2, in it's stationed position in the bore well. When fully inflated to wedge tightly, such wedging of the EPSE device within the bore well also counteracts the buoyancy of the pneumatic device, before the ESUWH is incorporated.

After introduced into the bore well, the navigation of the EPSE device is a carefully measured and monitored process to effectuate it's smooth descent, and to further successfully negotiate any sharp obstacles before it's designated stationing in the well bore marked by wholly preserved integrity of the innermost casing at and below, as mapped out by video and/or sonar devices.

In accordance with the cut section of the vertical or the axial structural scheme of the pneumatic sealer ensemble EPSE of FIG. 1 A, the EPSE device embodies a sturdy but expansive rubber coat 38 which is the bodily continuum of the upper and lower domes 10 and 12 that together form the surface structure of the EPSE ensemble. The EPSE device as a whole is expansive like a car tire, within the maximum thickness allowable for the needed expansion, depending also upon the size needed for it's expedition. Few hours or days after a catastrophic event, the deposition of the semisolid crude onto the uneven/sharp surfaces if any, makes the cave well of sojourn not particularly forbidding for the sealer ensemble, as it could be otherwise.

Figure 2A:
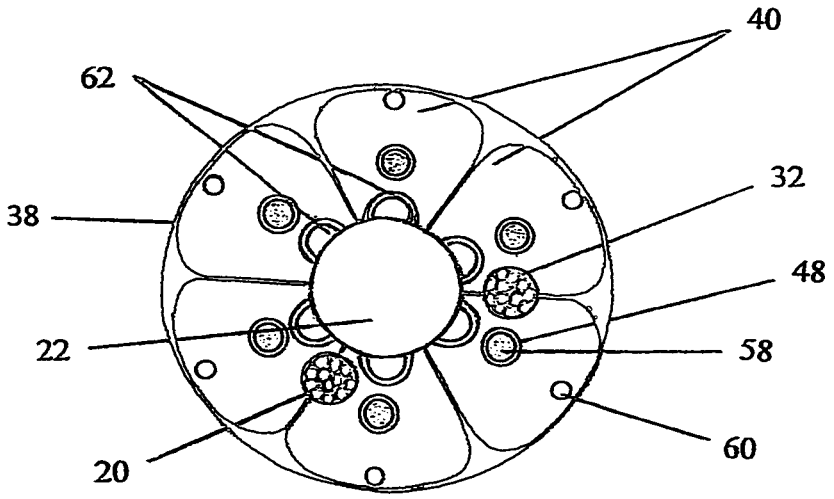
Figure 2B:
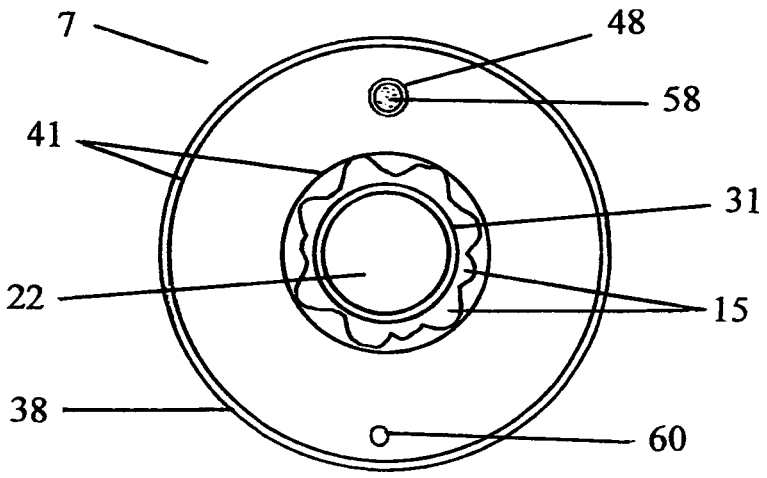

The embodiment further envisions that the rubber coat 38 that forms the pneumatic capsule comprises many smaller air capsules 40, ranging about 6-8, in each of the two sets positioned as one above the other, arranged in a circular manner like a whorl (in it's cross sectional design) around a central oil conduit 22, as shown in FIG. 1A and FIG. 2A. The air capsules 40 are at least 2 feet in average length, giving an average total height of 5 feet to the EPSE device. Smaller or larger sizes can also be made as per the need. Each air capsule 40 seems cylindrical or spindle shaped in configuration, as viewed in the vertical cut section of the device. In a horizontal cross-section however, each air capsule 40 is not circular, but is spatulate in configuration, with it's outer contour being expansive abutting the surface coat 38, and it's sides tightly approximating it's adjacent members (see FIG. 2 A)—creating a smooth circular outer contour to each set, with no indentations between the member air capsules that can otherwise allow oil leak (vs. circular cross-sectional configuration of the air capsules that may create deep surface indentations). The air capsules 40 are made of very expansive vulcanized rubber. Of the two similar sets of circularly arranged air capsules 40, the members of the upper set 44 are adjacent to the upper dome 10, and are attached at their upper ends, to the lower free surface of the upper dome 10. The lower set of air capsules 46 is adjacent to the lower dome 12, and the lower ends of the capsule members are attached to the upper free surface of the lower dome 12. Accordingly, when any one or more of the air capsules 40 deflate by sustaining a puncture, it/they will collapse towards the attachment(s), above or below. The upper and lower sets 44 and 46 are separated by a membranous partition 42, extending horizontally throughout, into the center of the interior, from the surface coat 38.

Each air capsule 40 has it's own tubular connection 48, that connects it to the air source. From the lower set 46, all the tubing emerge from the upper ends of the air capsules. From the upper set 44, they emerge from the bottom. Both the sets converge over the membrane 42 to ultimately travel as a single bundle to be enclosed in a sheath of non-compressible vulcanized rubber hose 20 that travels in close proximity with the EPSE body oil conduit 22, and further above with the oil conduit outlet tube 28. It may temporarily dissociate where the oil conduit tube has to be incorporated into the well head structure of the ESUWH, to approximate again with the oil conduit tube in it's further course, to finally dissociate to reach the destination of air pumping and air pressure monitoring unit.

A second or third set of tubing can start where ever is needed, the individual tubes connected to the corresponding tubes by a secure articulation, both tubing being similarly color coded. The tubes originating from the upper set 44 can have colors with intercepting black-banding, whereas the lower set 46 can have similar color without bands for the correspondingly positioned capsule members. The sets travel together (to the destination of the air pressure monitoring unit) in a weather resistant metal (helically wound) covered vulcanized rubber hose (with scattered eyelets for needed anchorage) colored outwardly as RED. The corresponding vertical pair of air capsules in sets 44 and 46 are similarly numbered, except that the capsule members of the upper set 44 are marked with U next to the number, whereas the capsule members of the lower set 46 are marked with L next to the number. Said pattern of color-coding is also observed for the additional sets of extension tubes to the point of their termination in the pressure monitoring unit. For the internal orientation of the individual capsule members within the EPSE device, at least one member's position has to be indexed with an emblem of an asymmetrical rubber/metal design (to identify clockwise or anticlockwise directions) situated on the upper dome 10, to be identified by sonar devices, so that all the air capsule members can be properly oriented within the EPSE device. The oriented positions of the emerging rubber hoses 20 and 32 (the details of the latter encountered in the following paragraphs) with respect to the metal emblem and oil conduit tube 22/28, and further with the adjacent air capsules comprising the sets 44 and 46 with their assigned numbers, as shall be diagrammatically mapped out by the manufacturer in cross sectional view, can also act as such markers of positional orientation of the individual capsule members.

Figure 3:
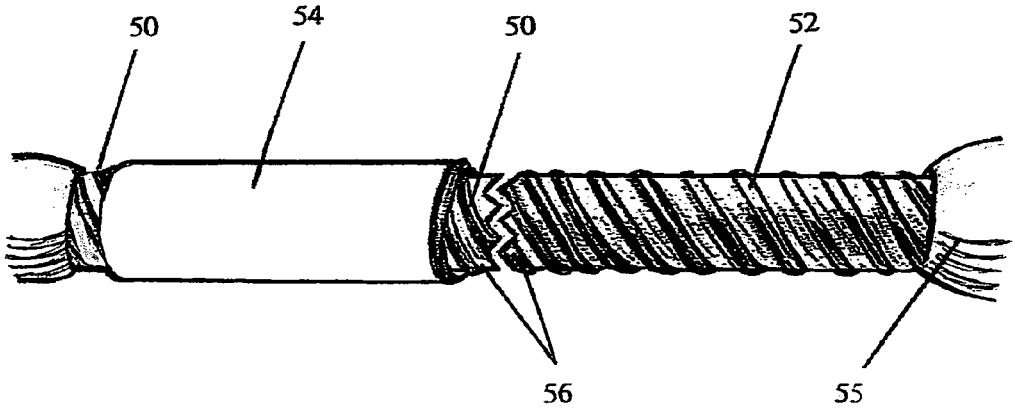

If necessary, articulation of the first and second sets of the air tubules of the travelling air hose 20 in the open and turbulent ocean waters has to be carefully planned, and must be done with due regard for correct articulation as well as air tight sealing required of each. At any articulation site, the vulcanized rubber hose housing the tubular members enlarges to be housed in a hemispherical metal structure, or any such suitable structure. The tubular members are fitted with metal terminals that also enlarge in size, and have the color matched numbers engraved on them for proper articulation with the corresponding members of the second set similarly sized, and have color matched numbers also engraved. Such enlargement facilitates optimally configured larger size suitable even for robotic articulation. FIG. 3 shows a joint articulation of the travelling air tubules with a sliding screw arrangement typically suitable in this setting. The articulating tubing of the first and second sets 50 and 52 of the joint articulation has similar threading externally, for substantial lengths of the joint terminal/origin. A sliding screw 54 having complimentary threading internally, and an internal diameter of a size that accommodates the external diameter of the first and second set terminal/origin 50 and 52, is a suitable type of joint in this setting. To start with, the sliding joint-screw 54 is situated completely on any one of the articulating members leaving it's end exposed, as shown in the FIG. 3. The ends 50 and 52 of the articulating members are snapped into approximation by needed design 56. In that position, the sliding screw 54 is slid over the corresponding articulating member by rotating movement through it's inner complimentary threading, so that it covers equal lengths of the members 50 and 52 of the joint. The rubber tubing 55 of the second set starts within the metal enclosure. After proper articulation of the terminals similar to 50 and 52 of the travelling air hose 20 the hemispherical enclosures are snapped close, securing the joint terminals inside. The enclosures are further secured by eye-lets locked with sufficient caliber metal wire, it's two ends making a number of secure twists over each other—a closure that can resist undoing by turbulent tides of the ocean in adverse weather. Similar articulation with a new tubing just outside the EPSE unit should be possible, in case the original rubber hose of the EPSE unit at any level is broken, though an enclosure is not needed at this level. It is very important that the manufacturer certifies the patency and functionality of the tubing and of the sealing device by actual prior testing of each unit (with a statement to that effect, instead of the company's 'warranty of assumption', usually done as a routine), a mandate needed of an emergency device to be preferably stocked in an off-shore work-unit.

All the air capsules 40 are guarded by automatic mechanical one way check valves 58 in the place where the tubes 48 enter the capsules. The valve allows air flow in only one direction, that is, towards the air capsule from it's tubular connection 48, and closes shut in the other direction. It is a safety device that precludes the entry of liquid/gas petroleum into the rest of the air circuit system if any one of the air capsules sustains a puncture.

It is necessary to deflate the air capsules 40 when the EPSE device has to be taken out of the bore well. It can be done by a simple plan. The ends of the air capsules 40 adjacent to the upper and lower domes 10 and 12, are devised to be connected to a set of tubing 60, and each in the set of the said capsular tubing 60 is similarly color coded as the corresponding capsular tubule 48 of the inflating set described earlier, and the set of tubing 60 also travel with the air tubing hose 20 to the air monitoring unit in a different vulcanized metal covered rubber hose 32, colored GREEN (with eye lets scattered at places for needed anchorage). The deflating set 60 can also arise from the air capsules 40 on the same side of the origin of the inflating set 48. The deflating air tubing set 60 is not provided with any type of mechanical valves. At the monitoring terminal, the air tubes 60 emerging from the GREEN hose 32, to start with are sealed or clamped, and are kept as such until the EPSE device needs to be deflated. During deflation, the seals or the clamps are opened, when air gets out of all the air capsules. It is imperative that the clamp of any punctured capsule is not opened (as oil can find it's way into the system) until the EPSE unit is taken out of the oil well. The air escapes with some pressure from the intact capsules. The articulation of the first and second sets of the travelling air hose 32 of the deflating tubular unit is similar to that of the inflating tubular unit of the air hose 20, earlier described.

The two rubber hoses 20 and 32 of the air tubing of the EPSE device can be anchored to the oil conduit EOCS unit tubing (described in the following section), as it is elongated in the well bore. The metal eyelets that are incorporated to the outside of the air tubing system travelling in the form of rubber hoses 20 and 32 can be tied to the EOCS unit at the places where it's snapping locks are placed, making a twisting knot with the metal wires through the U latch of the lock. Such close approximation stabilizes and strengthens the air tubing system in it's sojourn through the well bore. The air tubing system being incorporated into a rubber hose which itself has a thick metal helix as it's wall, is a safeguard to be kept diagonally uncompressible, and further to resist inadvertent attacks by the marine life forms, beyond the well.

Pressure monitoring for each air capsule 40 is separately done, and when the sealer EPSE ensemble is stationed in a suitable place in the bore well, all the air capsules 40 are filled equally to optimum pressure (that was previously calibrated by the manufacturers), and ascertained that the assembly as a unit is definitely enlarged to dimensions that far exceed the dimensions of the bore well, however below the safely attainable maximum pressure, which is separated by 'burst pressure' by a reasonable safety margin. Such built-in dimensions and prior calibrations allow the air capsule(s) to be further expanded and take over the space and volume of a lost member, by accidental puncture, thereby making no significant loss in the surface contour of approximation to the bore well interior. When a single member is lost by a gradual leak or by a leak due to explosive burst, it will be reflected in it's pressure record, as either a gradual loss or as a precipitous fall respectively. When pressure fall is observed in one monitor, the adjacent monitors are to be immediately observed to note if two other are showing gradual falling in their pressures, but stabilized after a lapse of time. These are reflective of the two adjacent members that are losing the pressure due to loss of surface tension, but not air volume. They can be differentiated by their ability to build back their pressures by pumping more air, whereas it is not possible with the member that was punctured. When such situation is encountered, the two adjacent capsules are to be expanded to their maximum allowable pressures, so that they can fully or partially replace the loss of air volume, and correct the gaps in the contour created in the upper or in the lower unit. If there is a gradual or a precipitous fall simultaneously in more than one air capsule not correctable by pumping of more air, it denotes that the damage is not localized, and that a wider area with puncture to multiple air capsules 40 is involved.

Devising the EPSE with upper and lower sets 44 and 46 of air capsules is to maintain the inflated surface contour of the device as a whole, as at least one among the two of the air capsules in a corresponding vertical position may escape puncture in a rough sojourn through the bore well, though the devised structure in this regard demands more involved design, also necessitating intensive monitoring. However, the detrimental consequences of the related calamities call forth such requisites, and a simpler design, also herein specified, can be chosen if a smooth descent of the EPSE unit in an intact bore well is reasonably expected.

The disclosed EPSE device may not be limited to the described structure, and any other creative additions can also be added to the basic assembly. An additional set of un-inflated members of air capsules 62 can also be incorporated within the device in reserve, to take over the place of a corresponding lost capsule. This can be done by devising each inflating tube 48 to be having two separate lumens to bifurcate at the level of the air capsule to establish connections with the inflated and the un-inflated reserve capsules separately. Both the sets are similarly structured with the provisions of the valves 58, and the deflating tubes 60. The lumens of the tubes 48 similarly bifurcate at the air pressure monitoring unit, and the lumens of the un-inflated reserve set are temporarily clamped, and any one opened only when it's inflated counterpart is punctured. It may be noted that through puncturing of it's counterpart, the un-inflated member will not establish connections with it's luminal system, for the simple reason that the two luminal systems are practically separate throughout, though structured as conjoined tubes, except at the bifurcations of both the terminals, and this structurally separate unit is simply not used, meaning it is not air inflated, until subsequently when needed. The members of the reserve set 62 are attached to the upper and lower surfaces of the central partition 42 of the EPSE device, and are structured to be packed-in to stay in close proximity with the central oil conduit tube 22 (see FIG. 2 A). This arrangement is to not to distort the contour of the inflated capsules peripherally. When any inflated member of the upper set collapses towards the upper dome 10, the corresponding member of the upper reserve set 62 expands above towards the upper dome 10, whereas the member of the lower set 62 similarly expands below towards the lower dome 12, to take over the position of any corresponding lost members of the lower set. The air tubules 48 of the first inflated capsules are coiled like a telephone cord at their entry into the air capsules, to allow their movements towards the domes 10 and 12, as their corresponding new members are expanded by inflation, to take their position. The bifurcated tubes corresponding to the first inflated air capsules of the sets 44 and 46 (attached to the domes) at the air monitoring terminal are strikingly thickened, to differentiate as the first set to be inflated, as their conjoined counterparts are similarly color coded. The reserve unit is an accessory option, and not a structural mandate of the basic EPSE device. The whole EPSE device can be replaced also if there is a puncture with significant oil leak through loss of contour, in a design without a reserve set. However, such punctures may be sustained again during the passage of the EPSE device through a damaged well casing, and the situation may not be any better despite duplication of efforts. The incentive for the inclusion of a reserve set of air capsules demanding involved design of the EPSE is that it removes uncertainty with anxious anticipation primarily due to the assurance of safe inflation of the well-guarded reserve set in the stationed position of the device, after the obstacles are passed.

The company manufacturing the device pre-calibrates the optimal maximum pressure and the burst pressure for the individual air capsules 40 of the EPSE device. Said optimal maximum pressure also represents the pressure allowable with safety margin for the individual air capsule 40 when 1-2 of the adjacent members are lost, whereas it is less when each capsule is inflated as a member of it's set wherein all are intact and inflated. Such submaximal pressures are calibrated for a particular size EPSE device to be securely wedging in a particular diameter casing annulus. These distinct numbers should be always readily available.

Integration of sonar equipment and monitoring can be done by outside equipment attached below and above the ensemble by any suitable means (the equipment can be securely anchored to the first articulating segment of the EOCS Unit).

The EPSEU Devised as an Emergency Pneumatic 'Simple Sealing Ensemble' (The SSE)—

The EPSEU is also built encompassing a simple design, called as an Emergency pneumatic 'Simple Sealing Ensemble' (SSE), shown in FIG. 1 B and FIG. 2 B. The device of 'Simple Sealing Ensemble' 7 comprises a single air capsule 41 enclosed in a rubber coat 38 and is more easily expandable by virtue of it's single air capsule compartment with accessory provisions similar to a typical air capsule described in the previous EPSE design. It has one reserve capsule 15, and is fitted with—a one way valve 58, a single inflating tube 48, and a single deflating tube 60. The device as a whole is structured like a car tire in it's cross section, but many times it's height (and with upper and lower domes 10 and 12), to cover sufficient vertical height in the well bore. It has a less involved design, and accordingly, is an easy maintenance.

The air capsule 41 to be inflated first in the SSE is attached to the center 13 of the outer coat 38 of the device, and expands in all dimensions, especially inwards, as it is inflated. The reserve member 15 has it's attachment in the center 17 of a rubber sheath 31 that surrounds the oil conduit 22, and expands mostly outwards when inflated. By virtue of it's well guarded position, the reserve member 15 is protected against any surface trauma. Because of the limited number of the connecting air tubing involved, they are easily color coded, and travel in a single hose 19 to the air pressure monitoring station. The detailed functionally oriented structure of the single air capsule 41 and the extension tubular system of the SSE device 7 is comparable to the involved design of the EPSE device described in the foregoing paragraphs including the sliding screw articulation model of the second/third sets of travelling air tubes of the inflating/deflating tubular systems. Similarly, it's outer physical structure encompassing the inlet and outlet oil conduit tubes (26 and 28) in continuum with the spool cylinders 18 and 24 are comparable to the EPSE device, as shown in the FIG. 1 B. The device's different pressure calibrations are also supplied by the manufacturers.

For oil wells with no injury sustained to the interior of the innermost casing, the SSE can be a suitable model, and should be a chosen design for it's less time taking installment, and simple monitoring techniques. The central oil conduit is identically structured, and air inflating pressure monitoring, and further, the deflating are similarly done, as in the previously detailed EPSE device.

The Emergency Oil Connecting and Stabilizing Unit (EOCS Unit) of the EPSE/SSE Device The 'Emergency Oil Connecting and Stabilizing Unit' (EOCS unit) is an embodiment that stabilizes the EPSE/SSE device against it's inherent buoyant effects, and that further connects it to the surface structures, thereby acting also as a connecting oil conduit. The EOCS unit is made of segmental, or of a straight-tube configuration. Mechanical counter force from above is the best way of stabilizing the pneumatic device anywhere in the bore well. The EOCS unit achieves that purpose, being also secured by surface anchorage. The EPSE/SSE device within itself has few feet of oil conduit pipe 22. The EOCS unit is it's connecting oil conduit added as 2.5 feet segments to a required length, to be terminally connected to the ESUWH at the well surface. Straight tubing similar to the 'production tubing' in it's structure can also be elected for a EOCS unit of a straight tube configuration, conforming to it's partial or whole axial length, in suitable setting as when the bore well to be navigated is straight with no significant obstacles to be maneuvered through.

Each said segment that is successively attached to the EPSE/SSE device is configured to be of metal tubing with threading on both ends that articulates with adjacent EOCS segments with complimentary threading. The articulations are tightened with rubber washers, and locked through eye-let holes of both segments that approximate when the segmental articulation is completely threaded and tightened. The eye-let joint is secured by a snapping lock similar to the one encountered in daily use for locking suit-cases, shelves etc. Said snapped locking can be very quickly accomplished even by robotic devices. By successive additions, one at a time, the tubing shall be progressively lengthened to the distance where the EPSE/SSE is required to be stationed in the borewell. The individual segment members can be chosen as long as possible, for easy and rapid elongation, the average range being 2.5-5 feet, though other sizes are not precluded, including a very long single tube, like the 'production tubing' itself, in suitable bore holes. After the EPSE/SSE device is stationed at the destined depth in the bore well, the last segment is added which is configured differently, that after it's emergence from the bore well on the surface, the tubing shall have structural configuration similar to the standard 'production tubing', to be connected at the well surface to the devised well head-like structure of the ESUWH.

The place and depth where the EPSE/SSE unit has to be stationed are mapped with sonar and video devices, and the depth accordingly maintained, by addition of the needed tubing that are also measurable. With each segment as big as 5 feet, and their secure articulations made in a snapping few seconds, the navigation of the EPSE/SSE device within the bore well tends to progress in a swift manner required of a catastrophic setting.

The rubber hose/air tubing of the EPSE/SSE device can be anchored to the EOCS unit as it is elongated. The metal eye-lets that are devised outside the air tubing system can be tied to the EOCS unit at places where the snapping locks are placed, making a twisting knot with metal wires through the U of the lock. Such close approximation stabilizes and strengthens the air tubing system in it's further course from the EPSE/SSE device.

(2) The Emergency Stabilizing Unit with Well Head-Like Device (ESUWH)

The prototype embodiment of an 'Emergency Stabilizing Unit with Well Head-like Device' (ESUWH) stabilizes and sustains the EPSE/SSE device with the EOCS unit incorporated. It is instrumental in overcoming the buoyancy effects of the pneumatic sealers, such buoyancy further compounded by the well pressure from below that the EPSE/SSE unit cannot resist, though it's inbuilt oil conduit to let out the oil is deemed to optimize the well pressure itself to certain extent. The said prototype embodiment of the ESUWH unit is a heavy weight device, made of steel, many tons in weight, structured like a round topped table incorporating 3-4 outwardly spanning legs with widening bottoms, to be drilled into and firmly cemented to the sea floor, a task deemed to be secure, yet easily and urgently accomplishable. It's top of exceeding diameter has a central hole (to resemble a bore hole with first casing cemented, the diameter of the latter in it's different marketed sizes being the 'corresponding diameter' for the ESUWH to be chosen) to accommodate a well head like structure—with casing hanger and other similar structures below, and with provisions on the top to incorporate a BOP that connects to the drilling riser. It is implied that the pre-explosion well head and it's structures are totally damaged/wiped out (as in BP's Horizon oil well blow-out), or else taken out of the way being proven dysfunctional. The circumference on the ocean grounds about the outwardly spanning legs of the ESUWH unit is chosen to surpass the circumference encompassing the maximum 'Diameter Of Disruption' (DOD) at the well head, and the ESUWH is configured to be incorporated into the soon to be constructed permanent 'Emergency Isolation Platform' (EIP) about the well head, described in the following section-4. The ESUWH unit can have a higher circumferential measure by means of additionally having articulating extra pieces projecting outwardly in equidistance, and incorporating the top's detachable legs. A sufficient overlap of the said radially adjustable pieces makes a firm and stronger articulation.

It is not labor intensive to cement the ESUWH device, and for such operation the base-piece of the drilling conductor at the well head is dismantled, in case it is in-situ. The three/four legs of the ESUWH spread out from the well area avoid and surpass the ground area of the Diameter Of Disruption (DOD), as is the aim during it's installment. The center of the devised table top of the ESUWH with a central circular passage hole within, is thickened or elaborated to house and stabilize the components needed for the well head-like structures. It is installed by robotic devices at the well head, as the needed manipulations are less complex. The ESUWH unit can be structured as: (1) 3-4 peripheral pieces of similar size and configuration articulating with the central circular piece with sufficiently firm overlap that is radially adjustable, with legs to be further incorporated, and (2) a separate circular central piece to embody the unit of table-top like structure described in the fore going, with legs to be further incorporated, with also provisions to be articulating if needed, with the peripheral structures as in (1) in the foregoing—both to be assembled on the ocean bed over the well surface by any method feasible and secure, such on-site operation aiming to surpass the variable DOD. It implies, the structure (1) is optional and an accessory. The structure of the base-piece of the drilling conductor soon to be deployed is devised to be bigger than the ESUWH. The base piece in-situ of the drilling conductor must be dismantled in all situations, to be fitted with a new base-piece devised to be structured as a funneled-sleeve required of the operation, however with the rest of the core structure of the functional unit and it's articulating ends unchanged. The structural incorporation of the ESUWH substantively suited as a metal frame/scaffold of the cement platform (EIP) soon to be constructed at the well surface is described in section-4.

(3) The Emergency Plugging Oil Conduit (EPOC)

The 'Emergency Plugging Oil Conduit' (EPOC) is a prototype embodiment that effectively plugs the 'production tubing' of a fully constructed well, if the tubing is damaged. Such damage can be cracks with oil leak, fractures involving substantial circumference, or it can be a total disconnect. Such damage of the 'production tubing' is usually located near the surface. Most packer hardware of the 'production tubing' are permanent and require milling in order to remove them from the production casing. If it is a retrievable packer, it can be easily removed.

Future models of 'production tubing' with threaded configuration can be easily closed with caps, or conjoined by threaded segments establishing a new connection of oil conduit. But old models with plain tubing and permanent packers, the situation can be riddled with problems, for an emergency replacement.

Accordingly, as an emergency measure, the oil conduit production tubing must be plugged, to occlude the leaks, and a new oil conduit created within the tubing lumen. The new oil conduit must further communicate with the well head-like structure of the ESUWH, at the well surface. The EPOC is doable at a very early stage when pressure within the oil containment is not built up to a significant degree by the sea water finding it's way into the containment reservoir.

Figure 4:
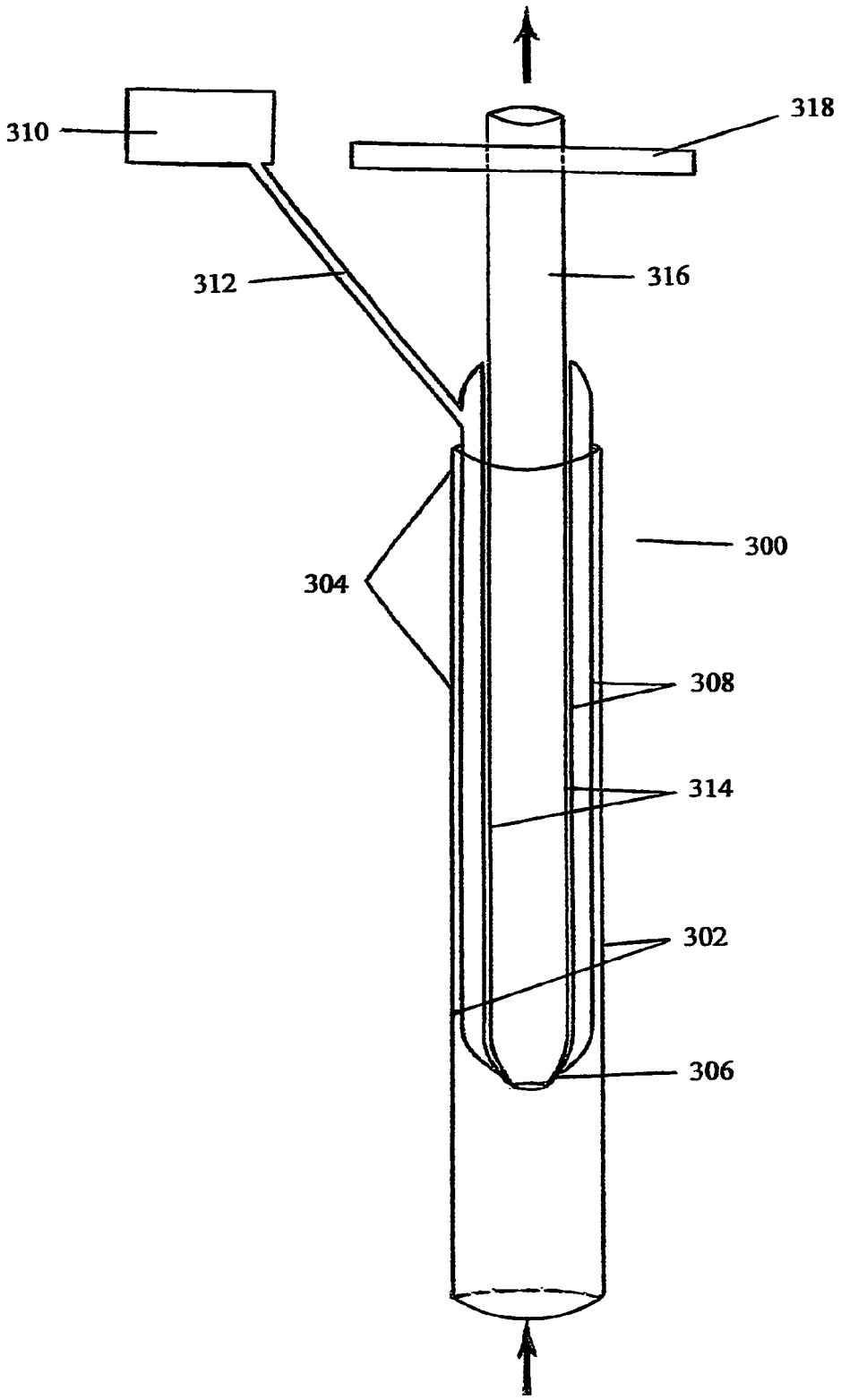

As schematically illustrated in FIG. 4, the embodiment of an 'Emergency Plugging Oil Conduit' (EPOC) comprises a metal (steel) tube with it's diameter designed to be 1-2 cm smaller than the in-situ 'production tubing' (5-10 cm standard diameter), and further incorporating a rubber sheath outside, on most of it's length. It is necessary that the upper component of the distorted or fractured in-situ 'production tubing' is completely severed, and taken out of the way.

The EPOC 300 is configured in variable standard lengths of many feet, to be passed into sufficient depth, through the open upper part 304 of the remaining lower component 302 of the 'production tubing', for a reliable occlusion through a substantial length. The EPOC 300 has metal component 314 that is made of steel. The lower terminal end 306 of the metal component 314 is slightly narrowed, and has a rounded rim, for easy maneuvering in it's passage. The metal component 314 of the EPOC 300 is capsulated over most of it's length with a strong and expandable vulcanized rubber sheath 308 that is connected at it's upper end to an air source 310 through a tubing of vulcanized rubber 312. The air tubing 312 is covered with a strong helical metal wire, and travels with the emerging oil-conduit metal tube 316, to dissociate only to reach the destination of air source, also having one or two joint connections on it's way, if needed—a scheme similar to the travelling air tubes of the EPSE unit described earlier. After the EPOC 300 is passed to a required depth into the remaining lower component of the production tubing 302, the outer capsular rubber sheath 308 is inflated through the inflating air tube 312 to completely plug the tube 302 across it's entire circumference, and throughout the length that the EPOC device 300 is passed into. After the full and required inflation of the rubber sheath 308, the tubing 312 is clamped at the monitoring terminal all the time, except to optimize the pressure within the pneumatic capsule/rubber sheath 308 by pumping more air, if the pressure is below the calibrated optimum. Oil can pass up through the lumen of the metal tube 314/316. At it's lower end 306, the tubing 314 is devoid of the rubber sheath 308 so as to ensure the tip of the tubing 314 to stay patent, and not to be occluded by the ballooning of the tip of the air-filled capsule 308. The upper end 316 of the metal tubing 314 that is connected to the well head like structure 318 of the ESUWH device is configured in a compatible manner resembling a 'production tubing', to be hung to the tubing hanger about the well head-like device of the ESUWH.

Very early plugging of the oil conduit accomplishes the most important goal of preventing the sea water finding it's way into the oil containment. Any delay can otherwise cause dangerous pressure to build up, making every sealing maneuver at this time difficult or virtually impossible. If the inciting calamity is a well blow-out at the surface, sealing the production tubing in the manner described prevents sea water finding it's way into the oil containment, despite the breaches in the innermost casing, as usually the damaged production tubing near the surface is the source of dangerous compromise in this situation, as the integrity of the lower completion is usually preserved.

With the plugging of the oil conduit accomplished, it is easy to concentrate on the reparative measures, as the well surface is also deemed to be clean at this time, without the petroleum/crude oil/gas contaminating the sea water.

(4) The Emergency Isolation Platform (EIP) of the Well Head

Emergency installment of conduction platform and drilling conductor is essential as soon as the rig and it's connections to the oil well are destroyed or dysfunctional. The structure of the base piece of the drilling conductor is devised to be far bigger (as an average of 50-60", whereas the higher dimensions are to be ordered urgently, a few days of wait time being acceptable, after the emergency EPSE device is installed into the bore well) than the presently manufactured and available maximum size, and the said base piece is configured as inverted funnel shaped to encircle the destroyed leaking bore well and isolate it from the rest of the oceanic bed. Stationing of the Detachable Island Rig (DIR) with it's functional conduction platform is a measure that saves precious and precarious time. A high reliability drilling riser that also functionally controls the BOP is paramount.

The footage of the detachable funnel base piece (sleeve) 142 of the drilling conductor is chosen to be about 30-40" wider than the largest diameter that defines the 'Diameter Of Disruption' (DOD) of the ocean floor about the well head, and should surpass the outer diameter of the conductor casing (the first casing). Such circumferential intact ocean floor is essential to drill a hole into the sea bed and then running the funnel base into the hole and cementing (143). There needs to be further stable ground within the funnel base piece, to construct a new cemented well-head platform for incorporating the table-top well head like structure of the ESUWH, wherein the cementing of a new 'reparative casing' of 1 or 2 strings depth is actuated, to seal all the fractures and breaches of the well bore.

The said funneled base piece 142 is of varying dimensions whereas the rest of the structure is unchanged, including it's joint with the piece immediately above. Imprecision being immaterial, the in situ cemented base piece of the drilling conductor can be severed from the sea floor by whatever means feasible (as any of it's sea ground remains are being cemented over, when the EIP is constructed). There must be reliable means to mechanically support the tubular of the drilling conductor above in the midst of ocean tides, as the supporting base piece is dismantled, in case dismantling the whole drilling conductor that is fully functional otherwise is not a choice, while the ESUWH is installed. Suspending each joint of the drilling conductor to a stable surface structure separately by metal chains on either side can be a choice, in case a secure surface suspension is doubtful.

Figure 5:
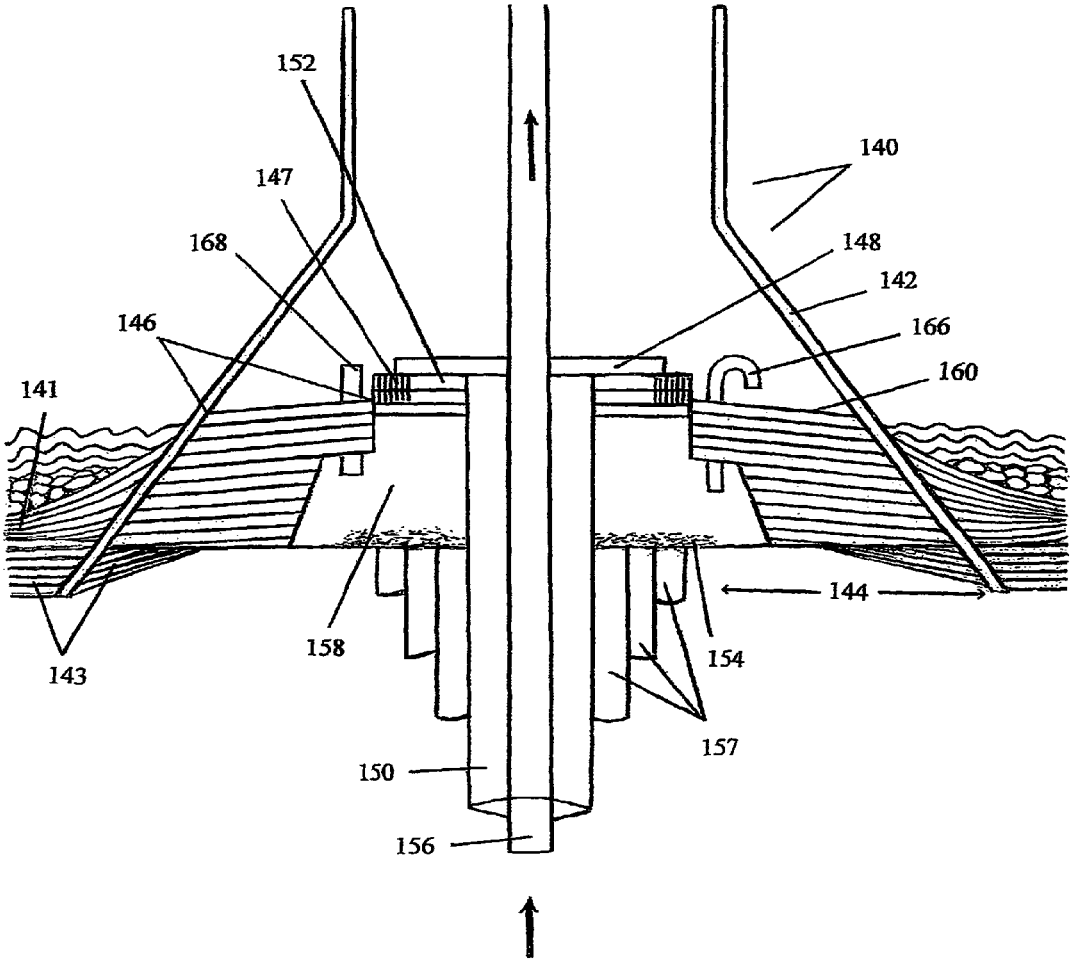

FIG. 5 shows the schematic model of the reparative construction at the well head involving a proposed model device of a detachable/attachable base structure of the drilling conductor 140. The said base structure typically has an inverted funnel-shaped base piece 142. If the damage at the well head is significant, the intact solid ground 144 around which the new conductor 140 rests should be sufficiently wide for a secure footage. As the funnel base piece is cemented, an overhanging/embedding sea floor 143 is created for more secure base structure, with a slab of cement, by means of using QUIKRETTE, Hydraulic Water Stop Cement (number 1126), a high strength material with quick consolidating properties even while wet, and available as above or below grade strengths, suitable for quick setting in 3-5 minutes. Manipulations by robotic arms are needed to aid the proposed overall construction. Within the tent like space on the top of the well head, created by the inverted funnel base, flexible steel metal sheets are wrapped around the metal legs of the ESUWH structure that was already installed. Cement slurry is poured around the metal sheets to tightly pack the space around it, as far as the boundary formed by the funnel base 142. It creates the elevated area 160 shown in the FIG. 5, forming a circumferential boundary of the circular room like area about the damaged well surface 154, said boundary surpassing the Diameter Of Disruption (DOD). The circular heightened cemented platform 146 conforming to the area 160 is built to be in flush with a centrally situated roof like design 148 formed by the well head like table top 152 of the ESUWH incorporating the structure 147, the latter with a diameter similar to the well's FIRST CASING. Such structuring is a means of bypassing the real or presumptively damaged ground 154, comprising the tops of the old casings 157. The damaged ground 154 can be covered with a metal sheet of similar dimensions with perforations to let out oil/gas emissions to the surface, but not the ground sludge, though in few days the ground settles and consolidates. A new REPARATIVE CASING 150 (smaller in diameter than the innermost casing that was previously installed in the casing set of 157), and an oil conduit 'production tubing' 156 pass through the center of the cemented roof, being suspended from the well head like structure 152, and hung to the incorporated tubing hanger, the latter having additional provision for the new smaller casing to be hung, a structural limitation of the devised well head. The cement structuring 1141 covers more of the circumferential dimension over the rim of the funnel 142, to further strengthen the cemented area 143, where the funnel base was originally cemented. The above sequence of construction has to be carefully planned. In wells where there was a blow out with the well leaking at the top, and there are ocean craters spilling oil, but no obvious ground damage identified at the well head by a reasonable search, a new REPARATIVE CASING (involving one casing string, and more if the video/sonar imaging so indicates) smaller than the well's innermost casing can be cemented in the usual manner without the need of constructing a cemented platform, an easier operation that can be quickly done, obviously with the prior placement of the EPSE sealing the well bore below, to be removed soon after. However, a provision for the smaller tubing to be hung should be additionally incorporated into the existing tubing hanger of the in-situ well head, if necessary. The new casing can seal any possible leaks into the ocean in the vicinity of the well. This is a very important preventive measure to be undertaken very early on, the better time to intervene, and must be integrated in the protocol of environmental control, whenever oil leak is observed at the well head after an adverse event. Reparative casing 150, smaller in diameter than the smallest available casing at present, should be manufactured, and available to those who used the smallest available casing as the innermost. Smaller sizes are readily available for the rest.

If it is a concern to the oil company that the redundant space under the funnel base may cause the straight component of the drilling conductor above to cave in, such space can be completely filled-in with cement (up to the junction of the straight and the funneling components of the base piece). If such a design is contemplated, the inverted J tube 166 and the straight tube 168 (detailed in the subsequent paragraphs) are structured in the roof of the EIP to be nearer to the reparative casing 150. As the base component 140 is detachable as it is attachable, the rest of the drilling conductor above it can be completely taken out if/when so decided at a later date.

If there is any surface explosion, usually the second string of the innermost casing (that is well bore deeper than 40 feet or 12 meters from the surface) is spared from any damage to the inside of the casement, and for this reason, installment of the first string alone can be sufficient. Video and/or sonar devices can be used to specifically examine the junction of the first and second string, and few feet below. To cement the NEW REPARATIVE CASING, overlying the first string of the innermost casing, the conventional process can be employed by circulating cement slurry into the casing shoe and the annulus, pumping through a plug and displacement fluid. At this time, the EPSE/SSE device can be lowered into the well bore beyond the depth of the first string, and it's oil outlet tube 28 capped with metal cap having complimentary threading, as also it can be assumed that pressure in the oil containment is optimized by this time. The EOCS Unit is disconnected for this purpose. Pressure recordings beyond the EPSE unit can also be documented for any concerns. Optimum pressure within the EPSE/SSE device, and tight wedging are paramount at this time to overcome the buoyant effects.

If it is a EPOC device plugging the 'conduction tube' that was in place as an emergency sealing device of the leaking well, it needs to be completely taken out along with the whole of the conduction tubing at this time, to station the EPSE device below the level of the first string, it's oil conduit capped, for cementing the reparative casing. If second string of the casing is found to be damaged by video or sonar devices, the EPSE device needs to be stationed below the junction of the second and third casing string, to cement a second string also.

With the foregoing structuring of the well head platform, it may not be assumed that the problem of oil leak from the well bore and the oil containment is thoroughly solved. It is not prudent to assume that the cementing of the REPARATIVE CASING can be accomplished in a perfect manner as it can be done for a new construction. A second blow-out, and an anxious anticipation must be ruled out by all means in this labor intensive restoration, while also hoping for a successful well salvage. To that effect, some simple remedial measures can be easily implemented during the construction of the well head platform. Oil let-out pipes as exemplified below, can be embedded within the roof of the cemented platform, so that any oil spill is let out. These oil let-out pipes are further fitted with one way check valves to only let out the oil/gas possibly emanating from the damaged well grounds 154.

1. A moderately sized tube 168 can be embedded in the roof of the cement platform with it's inlet opening into the space 1158, said tube fitted with one way check valves at strategic places, and the tube 168 courses up to be joining the main pipe, at any suitable level. The valves allow only the outlet pipe 168 to empty any collection of oil/gas into the main oil pipe. The one way valves can be multiple (at the level of the cement platform and at the level of main oil pipe), to improve efficiency. The tube 168 is inverted L shaped, it's horizontal limb entering the main oil pipe at 90°. Mechanical forces set up for the oil to flow upwards also help the entry tube to empty into the main oil pipe, and not the other way. The tube 168 is operative most of the times except when the main oil pipe or it's connection is disrupted, though the emergency isolation platform (EIP) is otherwise structurally and functionally intact, in which case the tube 168 is capped, and the J tube (166) (described below) is left open, to mitigate pressure build-up due to oil/gas collection within the enclosure of the EIP about the well head.

2. A moderately sized tube 166, inverted J shape in configuration, is set forth in the roof of the emergency isolation platform (EIP), fitted with one way valves to let-out only oil/gas, but not to let the sea water in. Through a threaded configuration it's outlet can be capped or uncapped. It's inlet is dipping into the space 158 of the EIP, whereas it's outlet is outside the cemented platform (EIP), thus traversing the thickness of the involved sloping cemented platform 146 of the newly constructed structure. The inverted J tube 166 is configured to let the oil/gas out from within the enclosure of the cemented platform in situations when the straight tube 168 is not operative, and the intact EIP is in open sea. In such circumstances the usually capped J tube 166 is uncapped to let out any built-in oil/gas from within the cemented platform. Because of the inverted J shape with it's outlet terminal facing downwards towards the ocean floor, any hydrostatic pressure due to true vertical height (TVH) of sea water at this level and exerted on the one way valves of the tube 166 is minimized (see the paragraph below) though positioned within an open sea (see also the below specified Pascal's law, not operative in this situation of unconfined body of sea water). Contamination of ocean waters with oil/gas due to emissions from J tube 166 is minimal, as it is capped after the restoration of the inverted L tube and the collecting tube, that is sooner than it would be otherwise, due to the devised threaded configuration all through the length, of the entire tubular system of the oil well/rig. The J tubes can be more than one in moderate sizes to ensure their intended function.

In the body of sea water, the pressure at the surface (the sea level) is equal to the atmospheric pressure, that is 760 mm/Hg, but the pressure rises 1 mm/Hg for each 13.6 mm distance below the surface. Though this 'hydrostatic pressure' at any point results from the weight of the vertical column of water above it, the hydrostatic pressure of the deep sea exerted on the valves of the inverted J tubes 166 in this situation is immaterial for the reason—that only the height of the column of fluid vertically above ('true vertical height', the TVH) any point of concern is what contributes to such hydrostatic pressure as in a situation where a tube has it's opening facing upwards, and thus subjected to the direct effects of TVH. Furthermore, the Pascal's law (the pressure exerted at any point in a closed body of fluid is equally exerted at all points with in that closed space) is also not applicable in this situation, and hence the hydrostatic pressure at the tip of the inverted J tube 166 is not subject to the effects of hydrostatic pressure from any other point in an open body of the adjacent sea water.

It is not implied that oil companies without DIR can not effectuate the structuring of 'THE EMERGENCY ISOLATION PLATFORM (EIP) OF THE WELL HEAD' along with the installation of NEW REPARATIVE CASING therein incorporated, to seal all the leaks and breaches of the innermost casing of the disrupted oil well. If the destroyed rig is not functional, any small portable rig with needed basic requirements for the planned structuring can be employed, and the subsequent oil collection can be done in any manner feasible, as many avenues are available for this purpose, including a small ship provided with massive oil tanks. The DIR is favored mostly for the safety of the crew, with the sense of security that comes along with it. As even the costly equipment or the rig as a whole is invariably insured, the economics of the situation may not be the greatest concern for the oil companies. It is a good idea that the well saLvaging devices described in this invention are stored elsewhere by the oil company to be readily available soon after a catastrophic event, as most of the emergency devices are structured in easily portable sizes. In rigs with DIR, they can be stored in the under-water basement, as it is deemed to be preserved even after a fire, and shall continue to serve as the powerhouse off-shore.

Multiple Leaking Craters in the Ocean Floor

If oil leak at different areas of the ocean floor is located by hovering airplanes, minimally filled-in appropriately sized balloons can be used to seal the ocean craters, and then permanently plug on the solid scaffold formed by the pneumatic sealer, by a structural combination of metal mesh and hydraulic water stop cement 1126 (QUIKRETTE). With reparative permanent casing and cement sealing of the bore well, such craters are certain to lose their connections to the oil well bore. The ocean body has to be carefully surveyed to spot the areas of identified past spillage, if they were of significant size and number, and at this later date, they are not expected to be seen.

(5) The Detachable Island Rig

A drilling rig can be defined as an unit of equipment built to penetrate the superficial and/or deeper aspects of the earth's crust. The rigs can be built as small and portable to be moved by single person, or they can be enormous in size and in complexity of functioning so as to house equipment used to: drill oil wells; sample mineral deposits that can impede functional units; identify geographical reservoirs; install underground utilities. Large units of drilling rigs, generally configured as more permanent land or marine based structures in remote locations are also facilitated with living quarters for laboring crews involved in well construction, at times hundreds in number.

The rig as described can be permanently based in the sea, or floating with partial submersion. Based on the cost of multiple equipment, and the life of personnel involved, even a major part of a permanently based rigs may be constructed as a detachable island from the area of conductor platform (stationing also a separate fire station and fire fighter's crew), the possible site of the initial fire or explosion. The detachable island should be separated from it by a stretch of fire proof corridor.

Ground stability can be a factor in opting for a permanent base. In the model herein described, the Detachable Island Rig (DIR) is an immovable structure with desired ground stability, yet with provisions to quickly steer away from the conduction platform, if the 'fire or dangerous gas alarm' goes off, as a warning to the crew. The detachable island of the rig is devised based on the fact that there is no need for the whole rig to be destroyed with the fire feeding on itself incessantly as it happened in the Deep Water Horizon Oil Well in the Gulf Shores. Whatever can be salvaged should be always salvaged, including all the personnel in one pack, working together for steering off of the DIR from the source of the fire, soon to be turning into a raging inferno.

Figure 6:
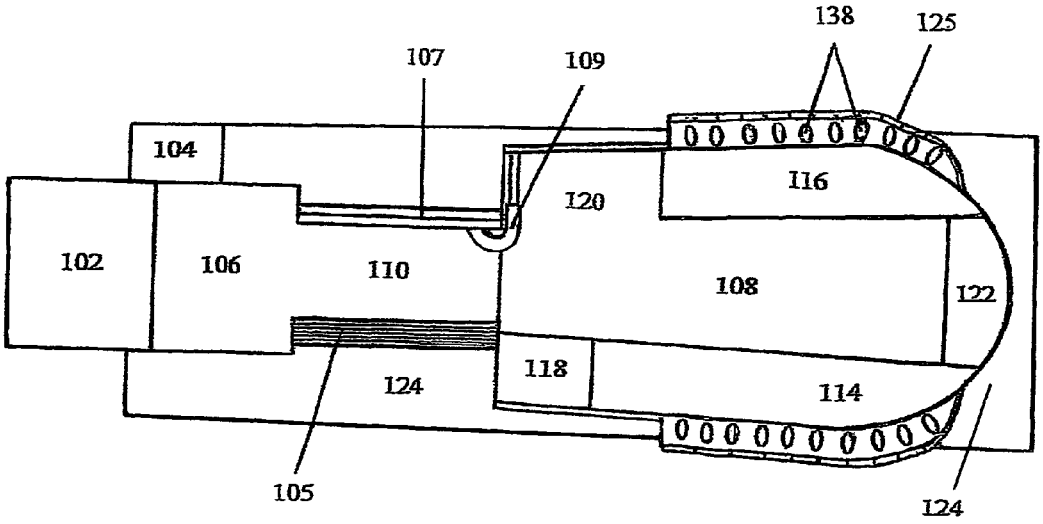

FIG. 6 shows the schematic diagram of a plan outline of a proposed typical rig that includes a 'Detachable Island Rig' (DIR) within it's structuring. Consistent with FIG. 6, on one end of the rig is the conduction platform 102 that also includes an appendage of fire station 104 with the crew. The adjacent segment 106 stations structures needed for the immediate operations of the conduction platform 102. The structures 102 and 106 are connected to the Detachable Island Rig 108 by a stretch of fire resistant corridor 110, sufficiently long, that also effectuates any tubing or wiring connections to the DIR 108, running on both sides of the corridor, one side accommodating electrical wiring 105, and the other side accommodating metal tubing 107. The metal tubing 107 is preferably substituted by a short segment of suitable rubber tubing 109 at the junction of the corridor 110 and the DIR 108. Every metal tubing in the rig has threading inside or/and outside, for immediate repair and articulation by 'joint tubing' devised in I, L, C, J or T shapes having a complimentary threading with a straight or nested configuration. The DIR 108 is detachable from the corridor and houses the costly and heavy equipment, supplies, needed reserves, working area 114 (having remote controls to the conduction platform, well head, and all functional and security devices), and living quarters 116 for the crew. Such separation of the DIR 108 through the fire resistant corridor 110 gives few minutes time for the DIR 108 to escape from the fire, and steered away from the permanent base structure of the rig. The DIR 108 also accommodates a fire station 118 with crew, additional conduction platform 120 with a basic structure to be fully equipped as needed, and a steering equipment with a powerful engine positioned in the farthest end 122, similar to that of a small ship in it's scope of operations. The DIR, as a whole is stationed on a cement platform 124, erected from the sea floor that behaves like a permanent base. It is most suitable if any structure like a room or a wall, either in the fixed base 102, 104, 106, or in the DIR 108 are designed to be easily dismantled, to be arranged into a different configuration as needed during the time of restructuring. It has to be noted that the schematic FIG. 6 only shows the possible plan of the rig, but may not exactly represent the true shapes or exact dimensions, as it is only intended to show a workable plan by which the detachment of the DIR 108 can be easily accomplished, and how the structural arrangement should be geared towards that goal.

Figure 7:
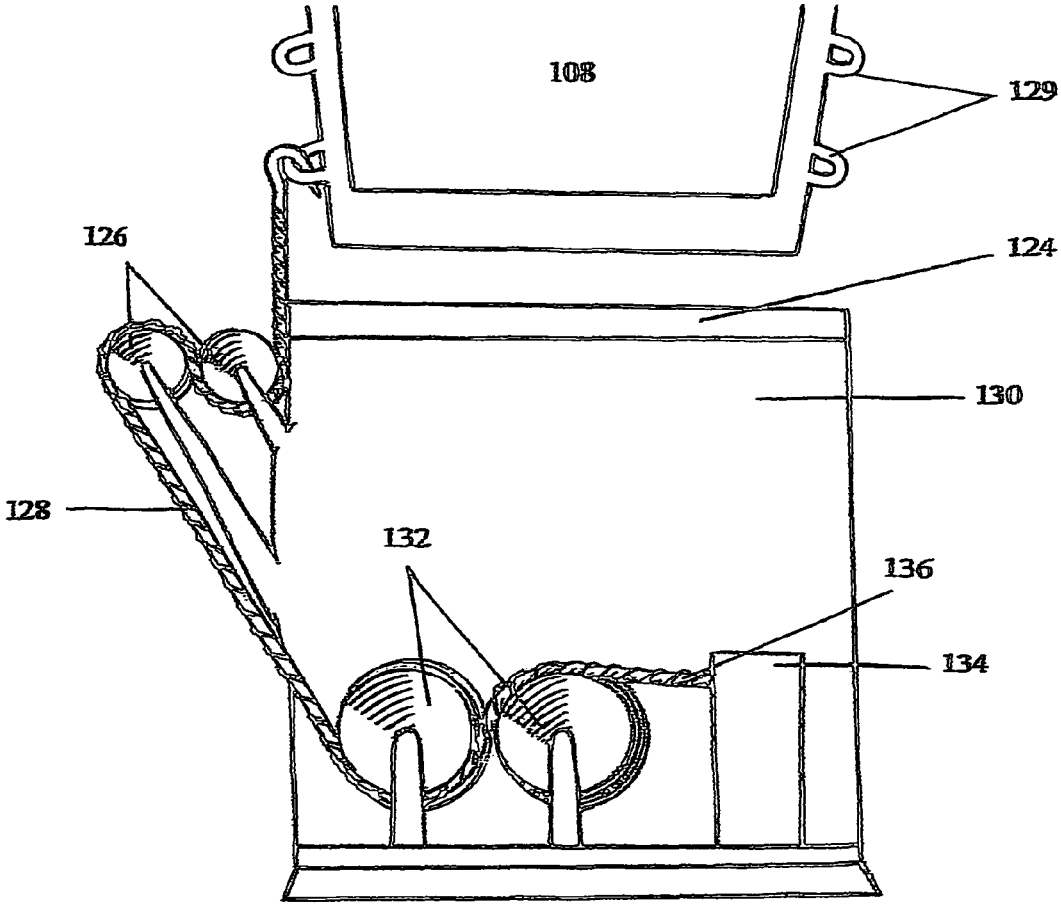

The concrete platform base 124 of the DIR 108 is so structured that it is at a sufficiently low level from the water surface, so that the island rig 108 can be steered down onto it, to be immovably locked in a desired position. To that effect, suitable mechanical forces have to be in place to overcome the built-in buoyant forces of the DIR, to bring it down by few inches, to be rested on the solid base 124. A device of double pulleys 126 as shown in FIG. 7, strategically positioned at multiple sites on the side walls of the concrete base 124 are devised to maneuver a set of sliding metal/steel ropes 128, their upper ends hooked to the ringed structures 129, positioned on the sides of the DIR 108, so as to correspond to the positions and intervals of the pulleys 126. Additional rings 129 can be positioned at higher levels also, as such positioning at times may be better operable for the steel ropes 128, to be exerting downward traction on the DIR 108. Traction of the steel ropes 128 on all pulleys 126 simultaneously will bring down the DIR 108 by few inches on to the concrete/steel base 124, to be stationed on it in desired position. The underwater basement 130 of the concrete permanent rig base 124 also houses devices of double pulleys 132 (in the corresponding positions of the pulleys 126 located on the walls of the concrete base), also working on the set of steel rope 128, exerting traction in a complimentary direction, the movement of the terminal part 136 of the metal ropes 128 being aided by the electrical forces of the motor equipment 134. In the maneuvered position of approximation of the pulleys 126 and the rings 129, the DIR 108 is also in a position for locking with the permanent base structure 124, effectuated by remote controls. After a secure locking, the steel ropes are detached from the rings 129 of the DIR.

It can be noted that when the detachable rig 108 returns to be stationed on the permanent base 124 after a rig fire destruction followed by needed demolition, all of the locking devices may not be properly approximated to be operative, but even few in strategic positions, especially in opposite corners are effective and functional for a stable DIR stationing, also aided by other suitable mechanical devices, if necessary. The underground basement also houses electrical generators needed for the whole operation of the rig. Being housed in such under water basement, the chances of the generators being destroyed by fire are minimized, this equipment being the ultimate 'power house' for survival off-shore.

In right positioning the DIR 108 can be locked (or unlocked) by mechanical equipment similar to the locking of a car door (in magnified size with an allowance for some imprecision) by a remote control. These locks are multiple and are located all around the floor, on all three sides except on the side 122, where the engine motor for the rig steering is located. Control buttons for locking and unlocking can be pressed one after the other, all being also controlled by a single universal button for each side, such universal buttons amounting to a total of three. With a fourth button, the engine of the steering station 122 is activated to take an automatic straight course until the control is taken over by the crew. The DIR can be constructed on a vertically adjustable platform, to conform to the rising and falling levels of the sea, so as to always maintain optimum submersion in sea water. It can also be structured to have retractable wheels like those of a shopping cart for finer adjustment of it's positioning on it's base platform. Any other mechanical anchoring devices available in the market can also be used for an immobile stationing of the DIR.

At the junction of the fire resistant corridor 110 and the DIR 108, a crash cart is equipped to disconnect the metal tubing 107, and the wiring 105 that connect the two areas 110 and 108. Each tubing and wiring is differently color coded, and every member of the crew including the fire fighters should know how to instantly disconnect or severe, and clamp or seal each tubing and the wiring. At the junction of the corridor 110 and the DIR 108, the metal tubes 107 are made of short connecting segments of rubber tubing. If they are coursing on the wall, this part of the connecting rubber tubing should have a U or C configuration 109 for easy clamping and cutting. The ends of each metal tubing 107 adjacent to the C or U junction can be clamped by mechanism similar to a tap. The wiring 105 is carefully cut and sealed on either side, with means to avoid an ignition spark. Working with remote devices as much as possible should be the priority to minimize the tubing and wiring. The signal to unlock the locking devices should be set by the key personnel carrying the remote control, as soon as the connecting tubes and wires are severed. Similar signal also activates the engine to speed steer the DIR 108, in an automated straight course away from the venue of danger. Multiple sheets of wet jute burlap stored in reserve in the roof structure in strategic places at different locations of the rig, and above heavy equipment, and thrown on burning objects/equipment, or affected crew members, is the most effective way of putting off the fire, even from inflammable gases, in conjunction with instantly closing the tubular systems (with devised threaded configuration of all the tubular systems, through their entire lengths) to shut off the unceasing inflammable gas emissions at any level, from the broken and otherwise irreparable tubular system (unlike the 36 hours of relentless rig-fire in the setting of BP's Deep Water Horizon Oil Well blow out).

If the DIR 108 had caught fire before or after it's detachment, powerful sprinklers spread all around, jetting water from the sea, should be activated, and control of fire should be easier as the DIR 108 is moving away from the source of danger. Rescue attempts from outside should be immediately activated also. Life boats 138 with wheels are also kept in reserve on board. They are positioned all around the periphery of the DIR 108 to be wheeled down into the water by projectile ramps 125.

The crew can move away only as far as it is deemed safe, but continuously working on the security and functional devices through remote controls, keeping vigilance on the expert professional fire crew left on the deck, working on preventing the well explosion. The DIR with crew can return to the original rig area as soon as the fire is put off, and station the DIR 108 to start the reparative process, using the additional conduction deck 120, if the damage to the immobile structures inclusive of the original conduction deck 102 is substantial, and cannot be immediately repaired. Quick surface demolition can be done, as in this situation, clearing of the wreckage into the ocean is easy and less time consuming than a ground demolition. The DIR 108 can be moved farther on to the concrete base so that the area 120 can over-lie the area 102. In this instance, the locks in this area of the base 124 may not be all around, but even few strategically placed locks are sufficient for structural stability. The basement housing the generators should be diligently constructed, to withstand any calamity so that immediate electrical circuiting is restored.

Once the reparative casing is cemented, and the production tubing placed using the new conduction platform to restore immediate well integrity, any further new and planned structuring of the rig can be done, for ongoing maintenance. Work and the amenities needed in the rig at this time are not as demanding as those that were needed at the time of well digging.

When it is clear by all means that the fire can not be contained by any available techniques, and staying back can only endanger the lives of the fire-fighter crew, every crew member should steer away, and nobody left behind. It is in the best interest of the crew that everybody gets training in basic fire-fighting, though few are experienced and highly skilled. Those skilled, and stayed back, should plan to jump into the ocean in life threatening situations or when they catch fire that could not be contained. They must dive-in as long as they can, in case they had caught fire (to avoid surface oil or crude that may not be visible in darkness) and must swim to clearer waters, that is, towards a direction away from the rig. The DIR crew should have powerful binoculars to keep vigilance, and as they steer away, they should let out some life boats into the ocean, that are anchored to the stable rig platform by lengthy ropes, so that the fire fighters who jumped into the water can reach them. The boats should have water-proof light source to be located if the calamity happens after darkness. The rig's underground basement should also be housing some life boats. The life boats employed in this situation should have provisions for the 'rescued' to get in swiftly, as the fire can be spreading on the water surface also. They should have two hanging ladders on one side. On the other side the hemi-section of the boat is built much heavier to stabilize the weight of the person and prevent the boat from toppling, as the person tries to climb up. The boats should have wheels in the bottom similar to those of a shopping cart so that the weight of the boat would not impede the swiftness needed. The boat on the side of the ladders should be painted with alternate black and white stripes (to aid approaching from the right side), whereas the rest of the boat is painted white that helps enhanced visibility in darkness (it can also help the rig crew spotting each other, and to be spotted by the rescue crew). All the boats should also have fire resistant surface, secured oars inside, and snaps for instant disengaging of the metal ropes, to steer away from the rig. The first aid materials for fire victims, including analgesics, should be stored in a water-proof compartment in each boat.

Insurance coverage of the damaged rig can be a factor in planning against a DIR. However, familiarity with the working devices of the old rig, remedial measures/damage control that can be immediately undertaken without losing precious time in a precarious situation when also such measures are easier, and most importantly, avoiding morbidity or mortality of the crew members—are the factors in favor of constructing a detachable island rig. Finding a new rig that fits the company's immediate needs and options is enormously time consuming causing indirect waste of money in such time lost. The insurance agreement can be planned for covering the needed construction, parts, and repair, to restore the fullest and the best functional state of the partly damaged rig, as such undertaking is very cost effective for the concerned insurance companies also.

(6) The Model of Oil Gas Separator (OGS)

The model of 'Oil Gas Separator' (OGS) is a prototype model that can be easily constructed on the oceanic grounds in the vicinity of the oil well, the proposed model being particularly designed to separate the gas from the liquid and semisolid crude petroleum oil at the source of formation, so that a giant bubble of inflammable gases will not find it's way to the rig, setting up fire by an otherwise insignificant spark. The OGS further mitigates the occasional failures of BOP when the entrained gas of immeasurable pressure can not be contained by the measured operations of it's valves and devices.

Figure 8:
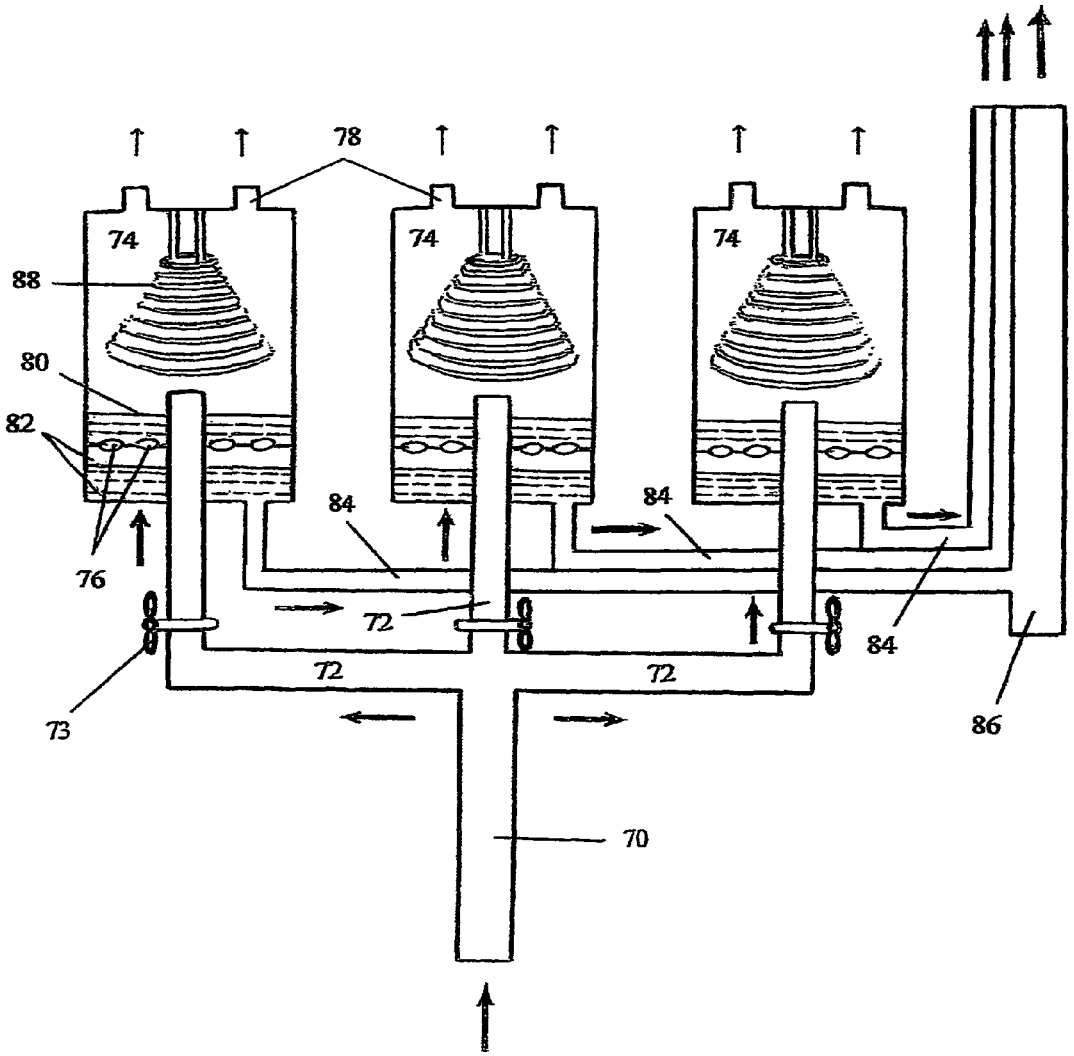

FIG. 8 shows such model which is simple in it's operation, and is devised different from the basic model of flow control by a 'valve' mechanism, because such valve mechanism at times failed, and let out the inflammable gases under high pressure. Though the valves are ingenious inventions, in certain set ups, as in oil wells, at times with immense pressures not elsewhere encountered, the valves inherently lack provisions to 'resist' these pressures. The valves are probably better suited to resist pressures originating from within the narrow caliber conduits, such as a 'production tubing', at least in few instances of unexpected pressures. However, when the innermost casing is the oil conduit, as (1) before a well completion, a situation similar to Deep Water Horizon Oil Well blow out, and (2) in high production wells, when high flow is planned without the construction of a 'production tubing'—the resistance of the BOP is against a well containment under greatest pressure. It can be compared to a narrow door controlling entry vs. wide gates fully open when the onslaught is naturally through a higher dimension. Most, though not all BOP failures probably happened/happen under such circumstance. Accordingly, it is prudent that yet another mechanism in conjunction be also set in place to mitigate the resulting calamity.

The FIG. 8, a schematic model of 'Oil Gas Separator' (OGS) on the ocean grounds, in the vicinity of the well head, shows the oil diversion tube 70 beyond the well head. The tube 70 is structured to further fork into 3-4 tubes 72, each forked oil tube 72 leading into a moderately large tank 74. Typically, the bottom of each tank 74 has wide sieve-like perforations 76 throughout, whereas the top of the tank is fitted with two outlet tubes 78. Each tank contains a small additional compartment 82 below the level of the sieved bottom, and the said compartment 82 also has a bottom outlet tube 84. The forked oil tubes 72 entering the tanks 74 are structured to rise few inches (about 8-10) from the bottom of the tanks to facilitate a fountain like drop-flow into the bottom of the tanks, as the oil overflows out of the tubes 72. Due to such structural arrangement, as soon as the oil gas mixture/crude enters the tanks 74 through the tubes 72, the oil (the semisolid plus liquid crude) over-flows down the tubes 72, and finds it's way through the wide perforations 76 in the bottom of the tanks to the compartments 82 below. The compartments 82 fitted with outlet tubes 84 let the oil out continuously from the bottom by mechanically aided outward flow. Whereas the liquid/semisolid oil flows down, the gaseous components of the crude naturally rise to the top of the tank to be led into the two outlet tubes 78, and then into separate gas collection system diverted away from the rig. The gas collection system is connected to specially devised receptacles with provision to deal with gases under high pressures. The outlet tubes 84 from all tanks join a single collecting tube 86, making their entry into the tube 86 at different levels, just outside the tanks.

The tubes 72 are fitted with external control on/off devices 73 to stop entry of oil/gas into any tank 74 when desired. The control devices 73 can also regulate the quantitative oil inflow in such a manner that the level 80 of the oil in the tanks 74 is kept below the terminals of the tubes 72 in the tanks 74, under usual circumstances, as shown in the FIG. 8. For new wells with very high flow, all tanks 74 are operational. When flow slows down, only 1 or 2 functioning tanks are sufficient.

Each tank 74 is fitted with a spirally wound churner 88, suspended from the roof of the tank, and structured in an inverted funnel configuration like a house hold kitchen mixer, it's bottom devised to be the widest. It moves up and down every few seconds, it's spring-action with axial downward thrust of all coils disrupting any semisolid crude blocking the perforations 76.

The proposed model encompasses a simple method that can be effectuated in the vicinity of the oil well, to separate the regularly encountered oil gas mixture, or occasionally encountered greater amount of admixed gas under significant pressure. The target is to mitigate dangerous calamities rather than 100% refining means of oil gas separation that is otherwise pursued by the 'oil production plants' engaged in exclusive crude oil separation (the 'oil refineries') by means of a highly involved process of 'fractional distillation'.

The OGS device is obviously intended to mitigate possible entrainment of inflammable gases into the petroleum collection system, and then into the rig, that may set up fire by an otherwise insignificant spark. Compared to the enormous resistance exerted by the conventional BOP (with both weight and pressure contributing to such pressure resistance), the device unit described as in the OGS seems too simplistic, but there is an inherent difference that is taken advantage of, to propose such a model. The principal involved in the BOP is to ultimately resist the well pressure when needed, especially if it is a giant gas bubble of entrained gases—but that it can fail to resist, as in the BP's Deep Water Horizon Oil Well blow-out. The OGS device makes no effort to resist such gas pressure simply for the reason that at certain threshold, it is clearly uncontrollable. Accordingly, it is prudent to let out such pressure, totally if possible, and in case it is only partial, at least the opposing pressure is optimized, for the surface BOP near the rig level to be able to control, and prevent a blow-out. Obviously, it is not the intension of the plan of the OGS device to control a liquid oil-gusher from the oil well. The OGS separator can be incorporated into the unit anywhere and by any means most feasible, the ocean grounds about the well head being the most beneficial venue. The oil conduit about the well head, by any suitable means, can be structured to have a diverting oil outlet tube, and a merging oil inlet tube, so incorporating the OGS unit into the oil collecting system, subject to separating the oil-gas at the source, at the earliest, precluding a giant gas bubble entering the rig at any time through-out the rig operation.

Workable Alternate Plan

For the BOP to control pressures involving most powerful of ruptures, in all high volume wells where such events can be reasonably expected, it is worth trying option to divide the oil line into multiple outlet conduits within the innermost casing and each outlet conduit is structured to pass through it's own stacks of BOP, so that each stack of BOP can tackle the divided power of the gusher, reduced to half, or one third of it's strength. It implies, it is a good practice to never allow a production casing (the innermost casing) to be a functioning oil conduit in high volume wells, a practice that takes out at the outset, probably an unrecognized brewing recipe for danger.

(7) Threaded Instant Joint Configurations

The invention further envisions a model of tubing directed to all tubular systems, and their methods of instant system joining or closing, for all future oil exploration units, or as a replacement tubing for existing units. The model of tubular systems are structured to be having a deep threaded configuration on the inside or the outside, traversing the whole length, facilitating instant joining or closing of a broken or intact system, aided by means of—(1) 'instant joint structures' shaped as I, T, J, L, C, U, Y etc. with complimentary threading, and having a straight or nested configuration, or (2) closing caps also with complimentary threading. The tubing involved can be production tubing, oil collection tubing, tubular system involving the rig, and any tubing wherein said configuration is deemed effective. Such structural mandate is as important as all the incorporated safety devices in case 'fire and well surface blow out' happen, resulting in a 'disconnect' in the system—when instant joining anywhere necessary is accomplished, or else instant closing of the system is similarly accomplished. The configured joint structures shaped as specified above, are used as one or multiple joints. I and/or T joints are usually needed to aid incorporate other joint structures, to restore a conduit line or complex interconnections. It does not imply that the threaded tubing is novel, but implementing such system in the context of oil wells, especially involving all tubular systems and traversing their entire length is novel, as only such model can instantly join or close the system anywhere at any time mitigating catastrophic consequences.

The invention claimed is:

1. An embodiment of invention, directed to exemplary models encompassing emergency devices and their methods, as means to salvaging a crumbled oceanic petroleum oil well, designed to be working in synchrony, not only by effectuating sealing an oil leak, but also by well salvaging reparative processes, thereby restoring either one or both of the temporary and permanent functioning of the well structure, incorporating the following—

(1) Emergency pneumatic sealing devices and their stabilizing instruments for effectively sealing a leaking oceanic petroleum oil well with the well head and an inner production casing disrupted, said devices structured to effectively seal:

(a) an incomplete oil well devoid of a 'production tubing' and a 'production packer', and having a disrupted innermost 'production casing', the production casing subject to be a dimension sealed, it's sealing device encompassing a device of Emergency Pneumatic Sealing Ensemble Unit (the EPSEU), either of simpler structural design, as the Emergency 'Simple Sealing Ensemble' (the SSE), or of involved/evolved structural design, as the Emergency 'Evolved Pneumatic Sealing Ensemble' (the EPSE), (b) a completed high production oil well, not destined for a 'production tubing', it's disrupted 'production casing' making an oil conduit, subject to be a dimension sealed, it's sealing device encompassing the device of 'Emergency Pneumatic Sealing Ensemble' Unit (the EPSEU), either of simpler structural design, as the Emergency 'Simple Sealing Ensemble' (the SSE), or of involved/evolved structural design, as the Emergency 'Evolved Pneumatic Sealing Ensemble' (the EPSE), (c) a completed oil well with fractured/severed 'production tubing', the lumen of the production tubing subject to be the dimension sealed, it's sealing device encompassing a device of pneumatic 'Emergency Plugging Oil Conduit' (EPOC), (2) an 'Emergency Oil Connecting and Stabilizing Unit' (EOCS) of the EPSE/SSE device, (3) an 'Emergency Stabilizing Unit Incorporating a Well Head like Device' (ESUWH), structured in heavy weight steel, and stationing at the disrupted oil well surface, subject to stabilizing the buoyancy effects of any pneumatic sealing device, and for further scaffolding a cemented 'Emergency Isolation Platform' (the EIP), to be subsequently structured about the well head, (4) materials and methods for emergency reparative measures involving the well surface of a disrupted oceanic petroleum oil well, subject to cement structuring an 'Emergency Isolation Platform' (EIP) about the metal scaffold of the ESUWH, configured to incorporate the well head structures, (5) emergency responsive methods directed to a marine rig subject to an ignition fire, and methods of designing a 'Detachable Island Rig (DIR)' stationed on a permanent base, (6) devices and their methods set forth to be best effectuated in the vicinity of the well head, directed to a model of 'Oil Gas Separator' (OGS) designed to mitigate the failing of a blow-out preventer (BOP) following entrainment of gases under a high pressure, such devices and methods subject to separating gas from solid and semi-solid crude, thereby precluding a giant gas bubble in formation to be otherwise entering the oil collection system optimally designed to be including only liquid and semisolid crude of petroleum oil.

2. An embodiment of invention, directed to the Emergency 'Evolved Pneumatic Sealing Ensemble' (the EPSE), with an involved/evolved design of claim 1, made of vulcanized rubber, subject to be sealing a fractured production casing, as an inflatable air sealer stationing in the well bore marked by wholly preserved integrity of the innermost casing at and below, as mapped by video/sonar imaging, such stationing aided with ease by emergent and robotic maneuvers, and the EPSE device subject to be—

(a) made of a spindled body of rubber coat, (b) having a length (vertical height) averaging 5 feet, and having diameter averaging 8 inches (exemplified for sealing an 'A' annulus of 9 and $5/8^{th}$ inches) prior to it's inflation, (c) having a central oil conduit of metal (steel) comprising an average diameter of 5-10 cm, (d) having an upper and a lower dome of reinforced vulcanized rubber housing metal spools with flanges, the hollowed cylinders of the spools making a joint and a continuum of the said central oil conduit of similar diameter, (e) wedging in the well-bore marked by wholly preserved integrity of the innermost casing at and below, the EPSE sub-maximally or maximally inflated, and subject to optimal calibrated pressure, maintaining a sufficient safety margin from it's burst pressure, (f) housing an upper and a lower set of inflatable air capsules of vulcanized rubber, separated by a horizontal central partition, the upper set attaching to the upper dome, and the lower set attaching to a lower dome, either set comprising 6-8 air capsules configured in a circular manner around the central oil conduit, and each of the air capsules having the below set forth means plus function—

1. having color-coded inflating air tubing of vulcanized rubber with automated mechanical one way check valve, the valve only allowing air flow towards the capsule, and the said air tubing coiling in it's redundant length before joining the air capsule, wherein the similarly color-coded tubing of the upper and lower sets is differentiated by intervening black banding of the upper set,
2. the said color coded inflating air tubing entering a red colored rubber hose coursing along the oil conduit, and emerging from the upper dome, to be further travelling to an air source/monitoring station,
3. each air capsule further more having similarly color coded deflating tubing with no valves, and travelling in a green hose to the monitoring station, wherein the tubing is generally clamped, except for deflating,
4. having means for an optimal maintenance of the wedge pressure of the EPSE device within the well bore, aided by an ongoing pressure monitoring of each capsule,
5. having means for detecting precipitous pressure fall of a punctured capsule member, and a gradual pressure fall of it's intact adjacent members, so aiding such adjacent members subject to more air pumping, for filling the lost contour of the pneumatic ensemble within the well bore,
6. the corresponding vertical pair of air capsules are similarly numbered except that the capsule members of the upper set are marked with U next to the number, whereas the capsule members of the lower set are marked with L next to the number,
7. the EPSE device having an asymmetrically structured metal emblem in the upper dome to help orienting the air capsules in clockwise and anti-clockwise directions within the device by sonar imaging, such orientation aided by diagrammatically mapped out cross-sectional view of the numbered capsules, supplied by the manufacturers, (g) housing a reserve set of air capsules attached to the central partition, packed-in to stay in close proximity to the central oil conduit, and having the below set forth means plus functions:

1. any of the reserve air capsules is inflated when the corresponding member is punctured,
2. each reserve capsule expanding towards the upper or lower dome,
3. the reserve air tubing system setting forth a conjoining system with the corresponding members of the inflated capsular system, the tubular systems forking at the entry into the air capsules, and further near their termination at the monitoring station,
4. their forking at the air station having a discerning thinner configuration,
5. having their forked tubular ends clamped at the air monitoring station, to be unclamped only for inflation, (h) the EPSE having threading to the outlet oil conduit tubing—to facilitate articulation with the complimentary threading of the EOCS unit; or to be closed by a threaded capping, to shut the oil-conduit, (i) the EPSE having provisions for a 'sliding screw' joint connections between the articulating sets of the travelling air tubular systems, to the destination of the air pumping and monitoring station, (j) the EPSE being the preferred embodiment to be sealing the oil well bore marked by substantive damage to the casement interior as found by video and/or sonar imaging, whereas a Simpler Sealing Ensemble (the SSE) is preferred for a bore well with preserved casement interior.

3. An embodiment of invention directed to the device of Emergency Pneumatic Sealing Ensemble Unit (EPSEU) of claim 1, encompassing a simpler design, the Emergency pneumatic 'Simpler Sealing Ensemble' (the SSE) made of vulcanized rubber, subject to sealing the productive casing of a leaking oceanic oil well, as an inflatable air sealer to be stationed in the well bore marked by wholly preserved integrity of the innermost casing at and below, as mapped by video/sonar imaging, the stationing subject to easy, emergent, and robotic maneuvers, and the said SSE device—

(a) having single functioning air capsule:

1. attached to the center of the outer coat of the pneumatic device,
2. encompassing an 'inflating' vulcanized air tubing with automated mechanical one way check valve, allowing air flow towards the air capsule,
3. having a 'deflating air tubing' of vulcanized rubber with no valve guarding, and clamped at the air source, except for deflating, (b) having single reserve air capsule encompassing similar configuration, and attaching in the center, to a rubber sheath that surrounds the oil conduit, the said air capsule expanding outwards when inflated, and subject to be clamped at the air source except for inflating, to be taking the position of the lost capsule, (c) comprising of a single rubber hose housing all air tubing, inflating and deflating, with defining color coding, and coursing along the central oil conduit, to be reaching the air monitoring unit, (d) conforming to a preferred embodiment when an intact casement interior of a leaking oil well is expected by video and/or sonar imaging, (e) apart from the foregoing differences if any, as a whole having a similar structural configuration as the EPSE device.

4. An embodiment of invention involving the 'Emergency Oil Connecting and Stabilizing' unit (EOCS unit) of claim 1, made of metal (steel), straight or segmental in it's axil length traversing the well bore, to function as a stabilizing unit and a connecting oil conduit of the EPSE/SSE device, the straight and/or segmental EOCS unit having the below set forth means plus functions:

(a) each lengthening segment measuring 2-5 feet or longer, (b) having a luminal diameter of 5-10 cm, similar to a production tubing, for setting forth an oil-conduit, (c) each segment articulating with the adjacent members by complimentary threading, (d) articulating below with the oil outlet tube of the EPSE/SSE device, (e) articulating above with the central piece of an 'Emergency Stabilizing Unit Incorporating a Well Head-like Device (ESUWH) about the well surface, (f) the segments articulating with each other having provisions of snapping metal locks through approximating eye-lets, such train of articulating segments progressing the EPSE/SSE device deeper, to it's destined station within the well bore.

5. An embodiment of invention encompassing the device of 'Emergency Plugging Oil Conduit' (EPOC) of claim 1, deployed to be sealing a leaking 'Production tubing', fissured and/or partially or completely fractured at any level in a disrupted leaking oceanic petroleum oil well, the said EPOC unit having the below specified means plus functions:

(a) a metal tubing of steel involving many feet in length directed to sealing a substantial length of an intact lower component of the production tubing, the disrupted/distorted upper component of the production tubing having been already dismantled, (b) a metal tubing of steel, configured 1-2 centimeters narrower than the standard corresponding production tubing of 5-10 cm diameter, (c) a metal tubing of steel, having a covering of vulcanized rubber capsule, to be inflated to a calibrated optimum pressure within a substantial length of the lumen of the retained lower component of the production tubing, for an effective pneumatic seal, (d) a metal tubing of steel having it's upper end structured in a similar manner as the production tubing, facilitating articulation with the well head-like structure encompassing the ESUWH unit, (e) a metal tubing of steel having it's pneumatic outer sheath of vulcanized rubber connecting to an inflating air source, and having an optimum air pressure monitoring for effective sealing until the time of it's planned deflation, (f) a metal tubing of steel with it's lumen functioning as the connecting oil conduit for the unplugged lower component of the production tubing, effectively preventing the pressure built-up below the deployed EPOC unit, (g) a metal tubing of steel with it's pneumatic outer capsule having helical metal-sheathed air tubing of vulcanized rubber, travelling with the oil collecting systems, to only dissociate to reach the destination of air source, the tubing further having provisions for joint connections with sliding screw articulations.

6. An embodiment of invention directed to an 'Emergency Stabilizing Unit with Well Head like Device' (ESUWH) of claim 1, devised to be in heavy weight metal (preferably of steel) for stabilizing and countering the buoyant effects of any of the pneumatic sealing devices stationed in the well bore, said ESUWH unit installed at the disrupted well head and having the below specified means plus functions:

(a) the ESUWH connecting with, stabilizing, and countering the buoyant effects of the EPSE/SSE device pneumatically sealing a leaking production casing, said connection effectuated by the 'Emergency Oil Connecting and Stabilizing' unit (EOCS unit), (b) the ESUWH connecting with, stabilizing, and countering the buoyant effects of the 'Emergency Plugging Oil Conduit' (EPOC) pneumatically sealing the retained lower component of the production tubing, (c) the ESUWH having a round topped table like configuration with detachable outwardly spanning and widening four legs, drilled into, and secured by cementing to the sea floor, it's footage on the ocean floor surpassing the maximum 'Diameter Of Disruption' (DOD) about the well head, (d) the ESUWH having provisions for further enlarging the circumferential dimensions of the table top, by having overlapping appendages in equidistance, wherein the detachable legs of the ESUWH articulate, their adjustable footage aiming to surpass the diameter of disruption (DOD), (e) the ESUWH further structurally conforming to a metal frame scaffold of the emergency isolation platform (EIP) soon to be built, making a permanent structure of the well head, (f) the ESUWH having a central hole in it's table top design is set forth to house a well-head like structure encompassing the diameter of the first casing having the configuration of a tubing hanger below, to which is hung subsequently, a smaller inner casement of 1-2 strings depth, cemented to the disrupted innermost casing.

7. An embodiment of invention encompassing the 'Emergency Isolation Platform' (EIP) of claim 1, a reparative permanent structure at the disrupted well head of an oceanic petroleum oil well, set forth in cement and metal, and subject to be comprising the following means and methods—

(a) means for installing a novel addition of inverted funnel shaped base piece of the drilling conductor sufficiently wide to be accommodating within, the Emergency Isolation Platform (EIP) on the said metal scaffold of ESUWH, the EIP built on a reliable ocean ground, and having it's footage surpassing the maximum diameter of disruption (DOD), (b) means for making a ring shaped elevated platform of cement about the ESUWH unit, with it's metal frame upon further addition of metal sheets conforming to a circumferential inner scaffold, and the inverted funnel base of the drilling conductor defining it's circumferential outer boundary, (c) means that the cemented platform is built to be in flush with the table top and the well head like structure of the ESUWH device, said cement structuring further enclosing the maximum DOD of the sea grounds, the latter conforming to the disrupted yet bypassed floor of the structured room-like enclosure, (d) means for the said ringed structure of the EIP to be built with cement slurry/QUIKRETTE (Hydraulic Water Stop Cement, number 1126, with quick consolidating properties even while wet) through robotic arms, (e) means for burrowing the funnel-base periphery of the drilling conductor under an overhanging cement-slab edge of the sea-floor, making a strong footage of the EIP about the well head, (f) means for structuring a smaller new 'reparative well casing' hung from the tubing-hanger of the ESUWH, to be cemented inside the smallest disrupted well casing (the 'production casing'), said smaller reparative casing encompassing a depth of 1-2 strings, wholly cement sealing the compromised well bore, the cementing involving conventional circulating of cement slurry into the casing shoe and the annulus, pumping through a plug and displacement fluid, (g) means that the cement roof of the EIP is further devised to be letting out any oil/gas emission making it's way from the disrupted floor of sea bed encompassing the DOD, such out-let devices conforming to two diverse structures exemplified below:

1. a wide tube in the cement roof fitted with one way valves to let the oil/gas out, the tube conforming to inverted L shape, it's horizontal limb joining the main oil pipe, such plan operative most of the time except when the main oil pipe or it's connection is disrupted though the EIP is intact, when the main pipe and the L tube are closed with threaded caps, whereas an inverted J shaped tube, also built in the roof is left open thereafter, to mitigate pressure build up within the EIP structure, intact in the open sea,
2. a similarly sized tube(s) is also structured in the cement roof, said tube having an inverted J shape and mechanical one way valves, only letting the oil/gas out, the one way valves in the open sea not letting any sea water in, being subject to no effects of the hydrostatic pressure (of the 'true vertical height') of the ocean waters due to the down turned opening of the J tube, the J tube uncapped only when the L tube is disrupted, and the intact EIP structure is in the turbulence of the open sea.

8. An embodiment of invention providing a model of tubing system and their methods of instant system joining or closing, for all future oil exploration units, or as a replacement tubing for existing units, directed to all tubular systems encompassing the preferred inventions of claim 1, the said tubing structured to be having a threaded configuration on the inside or the outside, traversing the whole length of any suitable tubing, facilitating instant joining or closing of a broken or intact system, aided by means of (1) 'instant joint structures' shaped as I, T, J, L, C, U etc. having straight or nested configuration, said 'instant joint structures' incorporated as one or more, aided by at least one or two I joints, for assembling and restoring a straight or a complex interconnections, or (2) 'closing caps' with complimentary threading, to instantly close any tubular system.

* * * * *